US007358913B2

(12) United States Patent
Ebling et al.

(10) Patent No.: US 7,358,913 B2
(45) Date of Patent: Apr. 15, 2008

(54) MULTI-BEAM ANTENNA

(75) Inventors: James P. Ebling, Ann Arbor, MI (US); Gabriel M. Rebeiz, La Jolla, CA (US)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 0 days.

(21) Appl. No.: 11/161,681

(22) Filed: Aug. 11, 2005

(65) Prior Publication Data

US 2006/0028386 A1 Feb. 9, 2006

Related U.S. Application Data

(63) Continuation-in-part of application No. 10/604,716, filed on Aug. 12, 2003, now Pat. No. 7,042,420, which is a continuation-in-part of application No. 10/202,242, filed on Jul. 23, 2002, now Pat. No. 6,606,077, which is a continuation-in-part of application No. 09/716,736, filed on Nov. 20, 2000, now Pat. No. 6,424,319.

(60) Provisional application No. 60/522,077, filed on Aug. 11, 2004, provisional application No. 60/166,231, filed on Nov. 18, 1999.

(51) Int. Cl.
*H01Q 19/06* (2006.01)

(52) U.S. Cl. ..... 343/753; 343/754

(58) Field of Classification Search ..... 343/700 MS, 343/909, 911 L, 753, 755, 853, 754
See application file for complete search history.

(56) References Cited

U.S. PATENT DOCUMENTS 3,170,158 A 2/1965 Rotman et al.

(Continued)

FOREIGN PATENT DOCUMENTS

EP 0 483 686 B1 4/1996

(Continued)

OTHER PUBLICATIONS

PCT International Search Report and Written Opinion of International Searching Authority in International Application No. PCT/US05/28662, May 12, 2006, 7 pages.

(Continued)

*Primary Examiner*—Hoanganh Le
(74) *Attorney, Agent, or Firm*—Raggio & Dinnin, P.C.

(57) ABSTRACT

A plurality of antenna end-fire antenna feed elements disposed along a contour on a dielectric substrate cooperate with a discrete lens array. An electromagnetic wave launched by an antenna feed element is received by a first set of patch antennas on a first side of the discrete lens array, and the associated received signals are propagated through associated delay elements to a corresponding second set of patch antennas on the opposite side of the discrete lens array from which the associated received signals are reradiated, wherein the corresponding delays of the associated delay elements are location dependent so as to emulate a dielectric electromagnetic lens and thereby provide for forming an associated beam of electromagnetic energy. A signal applied to a corporate feed port is switched to the antenna feed elements by a switching network, whereby different antenna feed elements generate different beams of electromagnetic energy in different directions.

25 Claims, 12 Drawing Sheets

U.S. PATENT DOCUMENTS 3,683,379 A 8/1972 Saddler et al.
3,713,163 A 1/1973 Keller et al.
3,754,270 A 8/1973 Thies
3,761,936 A 9/1973 Archer et al.
3,972,043 A 7/1976 Locus
3,984,840 A 10/1976 Dell-Imagine
4,087,822 A 5/1978 Maybell et al.
4,222,054 A 9/1980 Capps
4,268,831 A 5/1981 Valentino et al.
4,288,795 A 9/1981 Shelton
4,348,678 A 9/1982 Thomas
4,381,509 A 4/1983 Rotman et al.
4,638,322 A 1/1987 Lamberty
4,641,144 A 2/1987 Prickett
4,845,507 A 7/1989 Archer et al.
4,905,014 A * 2/1990 Gonzalez et al. ..... 343/909
4,983,237 A 1/1991 Alfing
5,099,253 A 3/1992 Archer
5,204,686 A 4/1993 Petrelis et al.
5,255,004 A 10/1993 Berkowitz et al.
5,274,389 A 12/1993 Archer et al.
5,313,213 A 5/1994 Neumann et al.
5,347,287 A 9/1994 Speciale
5,420,595 A 5/1995 Zhang et al.
5,428,364 A 6/1995 Lee et al.
5,446,470 A 8/1995 Avingnon et al.
5,451,969 A 9/1995 Toth et al.
5,486,832 A 1/1996 Hulderman
5,548,294 A 8/1996 Sturza
5,576,721 A 11/1996 Hwang et al.
5,583,511 A 12/1996 Hulderman
5,712,643 A 1/1998 Skladany
5,745,082 A 4/1998 Alder
5,821,908 A 10/1998 Sreenivas
5,828,344 A 10/1998 Alder et al.
5,874,915 A 2/1999 Lee et al.
5,892,487 A 4/1999 Fujimoto et al.
5,894,288 A 4/1999 Lee et al.
5,913,549 A 6/1999 Skladany
5,926,134 A 7/1999 Pons et al.
5,933,109 A 8/1999 Tohya et al.
5,959,578 A 9/1999 Kreutel, Jr.
5,963,172 A 10/1999 Pfizenmaier et al.
5,982,326 A 11/1999 Chow et al.
6,031,483 A 2/2000 Urabe et al.
6,031,501 A 2/2000 Rausch et al.
6,037,894 A 3/2000 Pfizenmaier et al.
6,043,772 A 3/2000 Voigtlaender et al.
6,046,703 A 4/2000 Wang et al.
6,061,035 A 5/2000 Kinasewitz et al.
6,104,343 A 8/2000 Brookner et al.
6,137,434 A 10/2000 Tohya et al.
6,157,621 A 12/2000 Brown et al.
6,198,449 B1 3/2001 Muhlhauser et al.
6,317,094 B1 11/2001 Wu et al.
6,362,788 B1 3/2002 Louzir
6,424,319 B2 7/2002 Ebling et al.
6,426,814 B1 7/2002 Berger et al.
6,590,544 B1 7/2003 Filipovic
6,606,077 B2 8/2003 Ebling et al.
6,867,741 B2 3/2005 Schaffner et al.
6,897,819 B2 5/2005 Henderson et al.
6,958,738 B1 * 10/2005 Durham et al. ..... 343/909
6,982,676 B2 * 1/2006 Sievenpiper et al. ..... 343/754
7,042,420 B2 5/2006 Ebling et al.
7,075,485 B2 7/2006 Song et al.
2002/0003505 A1 1/2002 Ebling et al.
2003/0006941 A1 1/2003 Ebling et al.
2004/0108963 A1 6/2004 Clymer et al.
2005/0068251 A1 3/2005 Ebling et al.
2005/0219126 A1 10/2005 Rebeiz et al.

FOREIGN PATENT DOCUMENTS

EP 0427470 B1 9/1996
GB 2331185 A 5/1999
WO 92/13373 A1 8/1992

OTHER PUBLICATIONS

Siegel et al., "The Dielectric-Filled Parabola: A New Millimeter/Submillimeter Wavelength Receiver/Transmitter Front End," IEEE Transactions on Antennas and Propagation, vol. 39, No. 1, Jan. 1991, pp. 40-47.

Gouker et al., "A Millimeter-Wave Integrated-Circuit Antenna Based on the Fresnel Zone Plate," IEEE Transactions on Microwave Theory and Techniques, vol. 40, No. 5, May 1992, pp. 968-977.

Schoenlinner et al., "77 GHz Transceiver Module Using A Low Dielectric Constant Multilayer Structure," 30th European Microwave Conference Paris France 2.-6.10.2000, Oct. 2000, pp. 245-248.

Abbaspour-Tamijani, A., "Novel Components for Integrated Millimeter-Wave Front-Ends," Ph.D. Dissertation, University of Michigan, Jan./Feb. 2004.

Abbaspour-Tamijani et al., "A planar filter-lens-array for millimeter-wave applications," 2004 AP-S Int. Symp. Dig., Monterey, CA, Jun. 2004.

Yngvesson et al., "The tapered slot antenna—a new integrated element for mm-wave applications," IEEE Trans. on Microwave Theory and Techniques, MTT-37, No. 2, Feb. 1989, pp. 365-374.

Schoenberg et al., "Two-Level Power Combining Using a Lens Amplifier," IEEE Transactions on Microwave Theory and Techniques, vol. 42, No. 12, Dec. 1994, pp. 2480-2485.

Sugawara et al., "A mm-wave tapered slot antenna with improved radiation pattern," 1997 IEEE MTT-S Int. Micorwave Symp. Dig., Anaheim, CA, Jun. 1997, pp. 959-962.

Demmerle et al., "A bi-conical multibeam antenna for space division multiple access," IEEE Antennas and Propagation Society International Symposium, Montreal, Aug. 1997, pp. 1082-1085.

Hollung et al., "A Bi-Directional Quasi-Optical Lens Amplifier", IEEE Transactions on Microwave Theory and Techniques, vol. 45, No. 12, Dec. 1997, pp. 2352-2357.

Popovic et al., "Quasi-Optical Transmit/Receive Front Ends", IEEE Transactions on Microwave Theory and Techniques, vol. 46, No. 11, Nov. 1998, pp. 1964-1975.

Wu et al., "Design and Characterization of Single and Multiple Beam MM-Wave Circularly Polarized Substrate Lens Antennas for Wireless Communications," IEEE Antennas and Propagation Society International Symposium, 1999 Digest, APS, Orlando, Florida, Jul. 11-16, 1999, New York, NY :IEEE, US, vol. 4, (Jul. 11, 1999), pp. 2408-2411, XP000935569, ISBN: 0-7803-5640-3.

Deal et al., "A new quasi-yagi antenna for planar active antenna arrays," IEEE Trans. Microwave Theory Tech., vol. 48, No. 6, Jun. 2000, pp. 910-918.

Vian et al., "A Transmit/Receive Active Antenna with Fast Low-Power Optical Switching", IEEE Transactions on Microwave Theory and Techniques, vol. 48, No. 12, Dec. 2000, pp. 2686-2691.

Gresham et al., "A compact manufactureable 76-77-GHz radar module for commercial ACC applications," IEEE Trans. on Microwave Theory and Techniques, vol. 49, No. 1, Jan. 2001, pp. 44-58.

Schoenlinner et al., "Spherical-Lens Antennas for Millimeter Wave Radars," European Microwave Week 2001 Proc., vol. 3, Sep. 2001, pp. 317-320.

Popovic et al., "Multibeam Antennas with Polarization and Angle Diversity", IEEE Transactions on Antennas and Propogation, vol. 50, No. 5, May 2002, pp. 651-657.

Schoenlinner et al., "Compact Multibeam Imaging Antenna for Automotive Radars," 2002 IEEE MTT-S Digest, Jun. 2002, pp. 1373-1376.

Schoenlinner et al., "Wide-Scan Spherical-Lens Antennas for Automotive Radars," IEEE Transactions on Microwave Theory and Techniques, vol. 50, No. 9, Sep. 2002, pp. 2166-2175.

Romisch et al., "Multi-Beam Discrete Lens Arrays with Amplitude Controlled Steering", IEEE International Microwave Symposium Digest, vol. 1-3, TH4B-1, Jun. 9-11, 2003, pp. 1669-1672.
Schoenlinner, B., "Compact Wide Scan Angle Antennas for Automotive Applications and RF MEMS Switchable Frequency Selective Surfaces", Ph.D. Dissertation, University of Michigan, Feb. 2004.
Grajek et al., "A 24-GHz High-Gain Yagi-Uda Antenna Array," IEEE Transactions on Antennas and Propagation, May 2004, pp. 1257-1261.
Simmons et al., "Radial Microstrip Slotline Feed Network for Circular Mobile Communications Array," in 1994 IEEE AP-S Int. Symp. Dig., Seattle, WA, Jun. 1994, 1024-1027.
Vaughan et al., "28 GHz Omni-Directinal Quasi-Optical Transmitter Array", IEEE Trans. Microwave Theory Tech., vol. 43, No. 10, Oct. 1995, pp. 2507-2509.
Vaughan et al., "Improved radiation pattern for 28 GHz omni-directional quasi-optical oscillator array," IEEE Antennas and Propagation Society International Symposium, Jun. 1995, vol. 3, pp. 1372-1375.
Vaughan et al., "InP-based 28 GHz integrated antennas for point-to-multipoint distribution", in IEEE Proc. Advanced Concepts in High Speed Semiconductor Devices and Circuits, Aug. 1995, pp. 75-84.
White et al.; "A wide-scan printed planar K-band microwave lens," Antennas and Propagation Society International Symposium, 2005 IEEE, vol. 4A, Jul. 3-8, 2005 pp. 313-316 vol. 4A.
Pozar et al., "Scan Blindness in Infinite Phased Arrays of Printed Dipoles," IEEE Trans. Antennas Prop., vol. AP-32, No. 6, pp. 602-610, Jun. 1984.
McGrath, D. T., "Planar Three-Dimensional Constrained Lenses," IEEE Trans. Antennas Prop., vol. AP-34, No. 1, pp. 46-50, Jan. 1986.
Pozar, D. M., "Flat lens antenna concept using aperture coupled microstrip patches," Electronic Letters, vol. 32, pp. 2109-2111, Nov. 1996.
Pozar et al., "Design of Millimeter Wave Microstrip Reflectarrays," IEEE Trans. Antennas Prop., vol. 45, No. 2, pp. 287-296, Feb. 1997.
Menzel et al., "A 76 GHz multiple-beam planar relfector antenna," 32nd European Microwave Conf. Proc., Sep. 2001, pp. 977-980.
Abbaspour-Tamijani et al., "AntennaFilterAtnenna Arrays as a Class of Bandpass Frequency-Selective Surfaces," IEEE Trans. Microwave Theory Tech., vol. 52, No. 8, pp. 1781-1789, Aug. 2004.
PCT Written Opinion of International Preliminary Examination Authority in International Application No. PCT/US05/28662, Jan. 4, 2007, 6 pages.

* cited by examiner

MULTI-BEAM ANTENNA

CROSS-REFERENCE TO RELATED APPLICATIONS

The instant application claims the benefit of prior U.S. Provisional Application Ser. No. 60/522,077 filed on Aug. 11, 2004, which is incorporated herein by reference. The instant application is a continuation-in-part of U.S. application Ser. No. 10/604,716, filed on Aug. 12, 2003, now U.S. Pat. No. 7,042,420, which is a continuation-in-part of U.S. application Ser. No. 10/202,242, filed on Jul. 23, 2002, now U.S. Pat. No. 6,606,077, which is a continuation-in-part of U.S. application Ser. No. 09/716,736, filed on Nov. 20, 2000, now U.S. Pat. No. 6,424,319, which claims the benefit of U.S. Provisional Application Ser. No. 60/166,231 filed on Nov. 18, 1999, all of which are incorporated herein by reference. The instant application is related in part in subject matter to U.S. application Ser. No. 10/907,305, filed on Mar. 28, 2005, now abandoned, which is incorporated herein by reference.

DETAILED DESCRIPTION OF EMBODIMENT(S)

Figure 1:
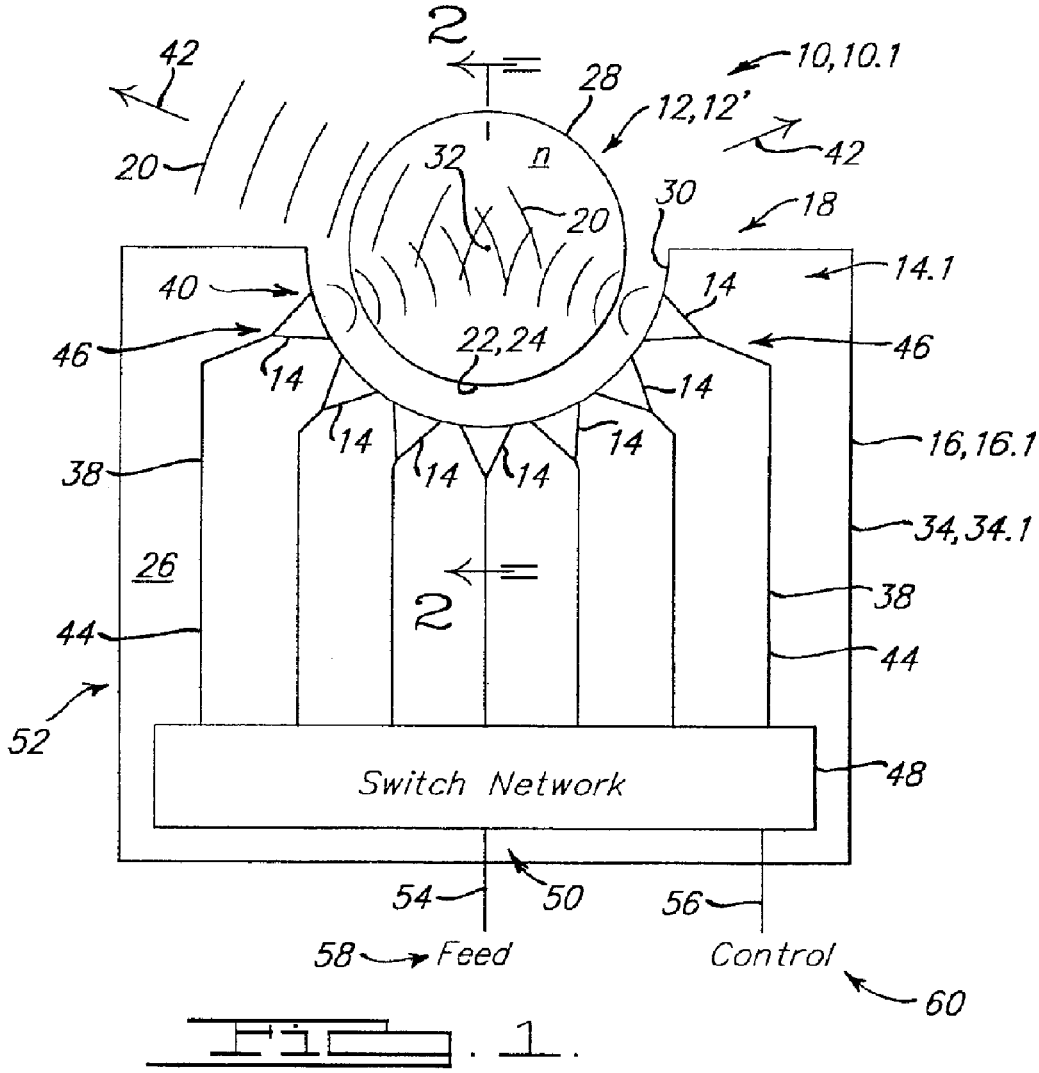
FIG. 1 illustrates a top view of a first embodiment of a multi-beam antenna comprising an electromagnetic lens.
Figure 2:
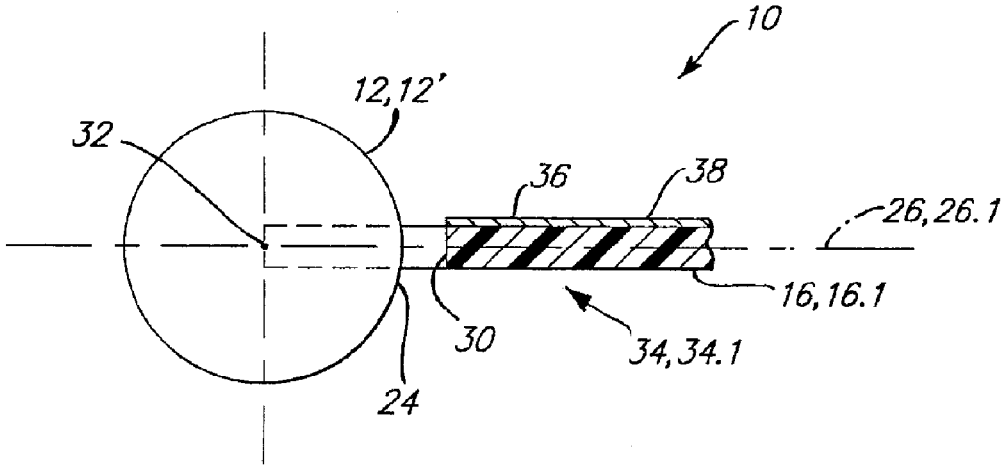
FIG. 2 illustrates a fragmentary side cross-sectional view of the embodiment illustrated in FIG. 1.

Referring to FIGS. 1 and 2, a multi-beam antenna 10, 10.1 comprises at least one electromagnetic lens 12 and a plurality of antenna feed elements 14 on a dielectric substrate 16 proximate to a first edge 18 thereof, wherein the plurality of antenna feed elements 14 are adapted to radiate or receive a corresponding plurality of beams of electromagnetic energy 20 through the at least one electromagnetic lens 12.

Figure 3:
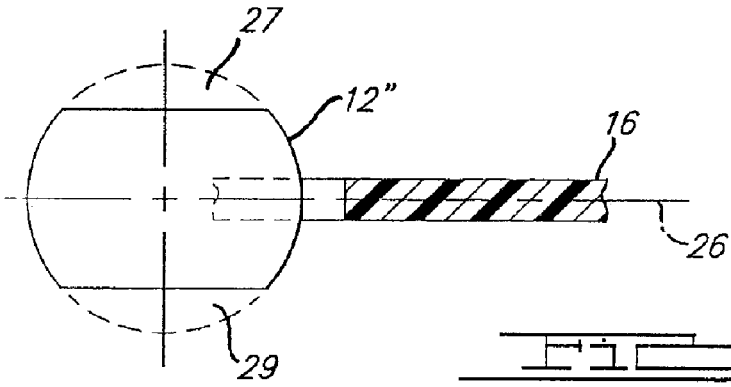
FIG. 3 illustrates a fragmentary side cross-sectional view of the embodiment illustrated in FIG. 1, incorporating a truncated electromagnetic lens.

The at least one electromagnetic lens 12 has a first side 22 having a first contour 24 at an intersection of the first side 22 with a reference surface 26, for example, a plane 26.1. The at least one electromagnetic lens 12 acts to diffract the electromagnetic wave from the respective antenna feed elements 14, wherein different antenna feed elements 14 at different locations and in different directions relative to the at least one electromagnetic lens 12 generate corresponding associated different beams of electromagnetic energy 20. The at least one electromagnetic lens 12 has a refractive index n different from free space, for example, a refractive index n greater than one (1). For example, the at least one electromagnetic lens 12 may be constructed of a material such as REXOLITE™, TEFLON™, polyethylene, polystyrene or some other dielectric; or a plurality of different materials having different refractive indices, for example as in a Luneburg lens. In accordance with known principles of diffraction, the shape and size of the at least one electromagnetic lens 12, the refractive index n thereof, and the relative position of the antenna feed elements 14 to the electromagnetic lens 12 are adapted in accordance with the radiation patterns of the antenna feed elements 14 to provide a desired pattern of radiation of the respective beams of electromagnetic energy 20 exiting the second side 28 of the at least one electromagnetic lens 12. Whereas the at least one electromagnetic lens 12 is illustrated as a spherical lens 12' in FIGS. 1 and 2, the at least one electromagnetic lens 12 is not limited to any one particular design, and may, for example, comprise either a spherical lens, a Luneburg lens, a spherical shell lens, a hemispherical lens, an at least partially spherical lens, an at least partially spherical shell lens, an elliptical lens, a cylindrical lens, or a rotational lens. Moreover, one or more portions of the electromagnetic lens 12 may be truncated for improved packaging, without significantly impacting the performance of the associated multi-beam antenna 10, 10.1. For example, FIG. 3 illustrates an at least partially spherical electromagnetic lens 12" with opposing first 27 and second 29 portions removed therefrom.

Figure 4:
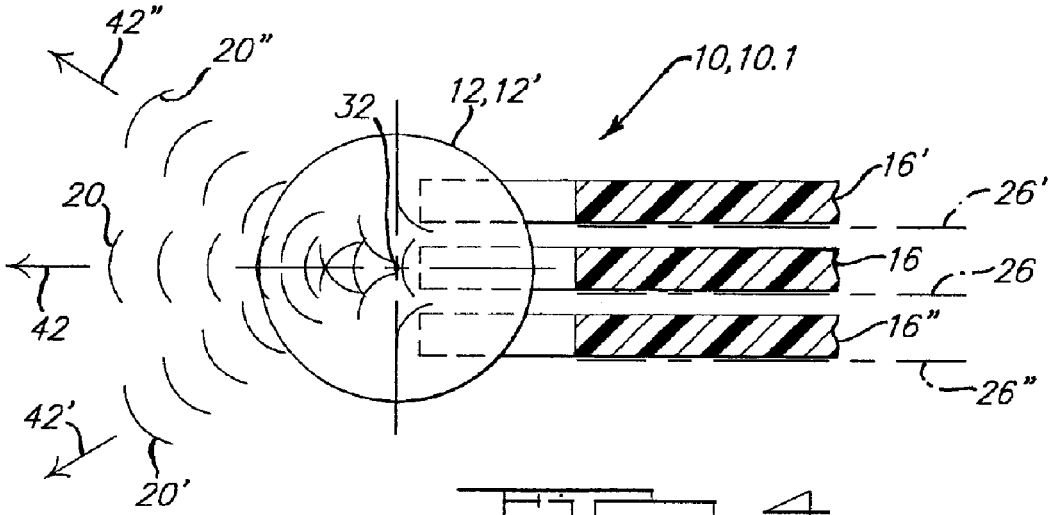
FIG. 4 illustrates a fragmentary side cross-sectional view of an embodiment illustrating various locations of a dielectric substrate, relative to an electromagnetic lens.

The first edge 18 of the dielectric substrate 16 comprises a second contour 30 that is proximate to the first contour 24. The first edge 18 of the dielectric substrate 16 is located on the reference surface 26, and is positioned proximate to the first side 22 of one of the at least one electromagnetic lens 12. The dielectric substrate 16 is located relative to the electromagnetic lens 12 so as to provide for the diffraction by the at least one electromagnetic lens 12 necessary to form the beams of electromagnetic energy 20. For the example of a multi-beam antenna 10 comprising a planar dielectric substrate 16 located on reference surface 26 comprising a plane 26.1, in combination with an electromagnetic lens 12 having a center 32, for example, a spherical lens 12'; the plane 26.1 may be located substantially close to the center 32 of the electromagnetic lens 12 so as to provide for diffraction by at least a portion of the electromagnetic lens 12. Referring to FIG. 4, the dielectric substrate 16 may also be displaced relative to the center 32 of the electromagnetic lens 12, for example on one or the other side of the center 32 as illustrated by dielectric substrates 16' and 16", which are located on respective reference surfaces 26' and 26".

The dielectric substrate 16 is, for example, a material with low loss at an operating frequency, for example, DUROID™, a TEFLON™ containing material, a ceramic material, or a composite material such as an epoxy/fiberglass composite. Moreover, in one embodiment, the dielectric substrate 16 comprises a dielectric 16.1 of a circuit board 34, for example, a printed circuit board 34.1 comprising at least one conductive layer 36 adhered to the dielectric substrate 16, from which the antenna feed elements 14 and other associated circuit traces 38 are formed, for example, by subtractive technology, for example, chemical or ion etching, or stamping; or additive techniques, for example, deposition, bonding or lamination.

The plurality of antenna feed elements 14 are located on the dielectric substrate 16 along the second contour 30 of the first edge 18, wherein each antenna feed element 14 comprises at least one conductor 40 operatively connected to the dielectric substrate 16. For example, at least one of the antenna feed elements 14 comprises an end-fire antenna element 14.1 adapted to launch or receive electromagnetic waves in a direction 42 substantially towards or from the first side 22 of the at least one electromagnetic lens 12, wherein different end-fire antenna elements 14.1 are located at different locations along the second contour 30 so as to launch or receive respective electromagnetic waves in different directions 42. An end-fire antenna element 14.1 may, for example, comprise either a Yagi-Uda antenna, a coplanar horn antenna (also known as a tapered slot antenna), a Vivaldi antenna, a tapered dielectric rod, a slot antenna, a dipole antenna, or a helical antenna, each of which is capable of being formed on the dielectric substrate 16, for example, from a printed circuit board 34.1, for example, by subtractive technology, for example, chemical or ion etching, or stamping; or additive techniques, for example, deposition, bonding or lamination. Moreover, the antenna feed elements 14 may be used for transmitting, receiving or both transmitting and receiving.

Referring to FIG. 4, the direction 42 of the one or more beams of electromagnetic energy 20, 20', 20" through the electromagnetic lens 12, 12' is responsive to the relative location of the dielectric substrate 16, 16' or 16" and the associated reference surface 26, 26' or 26" relative to the center 32 of the electromagnetic lens 12. For example, with the dielectric substrate 16 substantially aligned with the center 32, the directions 42 of the one or more beams of electromagnetic energy 20 are nominally aligned with the reference surface 26. Alternatively, with the dielectric substrate 16' above the center 32 of the electromagnetic lens 12, 12', the resulting one or more beams of electromagnetic energy 20' propagate in directions 42' below the center 32. Similarly, with the dielectric substrate 16" below the center 32 of the electromagnetic lens 12, 12', the resulting one or more beams of electromagnetic energy 20" propagate in directions 42" above the center 32.

The multi-beam antenna 10 may further comprise at least one transmission line 44 on the dielectric substrate 16 operatively connected to a feed port 46 of one of the plurality of antenna feed elements 14, for feeding a signal to the associated antenna feed element 14. For example, the at least one transmission line 44 may comprise either a stripline, a microstrip line, an inverted microstrip line, a slotline, an image line, an insulated image line, a tapped image line, a coplanar stripline, or a coplanar waveguide line formed on the dielectric substrate 16, for example, from a printed circuit board 34.1, for example, by subtractive technology, for example, chemical or ion etching, or stamping; or additive techniques, for example, deposition, bonding or lamination.

The multi-beam antenna 10 may further comprise a switching network 48 having at least one input 50 and a plurality of outputs 52, wherein the at least one input 50 is operatively connected—for example, via at least one above described transmission line 44—to a corporate antenna feed port 54, and each output 52 of the plurality of outputs 52 is connected—for example, via at least one above described transmission line 44—to a respective feed port 46 of a different antenna feed element 14 of the plurality of antenna feed elements 14. The switching network 48 further comprises at least one control port 56 for controlling which outputs 52 are connected to the at least one input 50 at a given time. The switching network 48 may, for example, comprise either a plurality of micro-mechanical switches, PIN diode switches, transistor switches, or a combination thereof, and may, for example, be operatively connected to the dielectric substrate 16, for example, by surface mount to an associated conductive layer 36 of a printed circuit board 34.1.

In operation, a feed signal 58 applied to the corporate antenna feed port 54 is either blocked—for example, by an open circuit, by reflection or by absorption, —or switched to the associated feed port 46 of one or more antenna feed elements 14, via one or more associated transmission lines 44, by the switching network 48, responsive to a control signal 60 applied to the control port 56. It should be understood that the feed signal 58 may either comprise a single signal common to each antenna feed element 14, or a plurality of signals associated with different antenna feed elements 14. Each antenna feed element 14 to which the feed signal 58 is applied launches an associated electromagnetic wave into the first side 22 of the associated electromagnetic lens 12, which is diffracted thereby to form an associated beam of electromagnetic energy 20. The associated beams of electromagnetic energy 20 launched by different antenna feed elements 14 propagate in different associated directions 42. The various beams of electromagnetic energy 20 may be generated individually at different times so as to provide for a scanned beam of electromagnetic energy 20. Alternatively, two or more beams of electromagnetic energy 20 may be generated simultaneously. Moreover, different antenna feed elements 14 may be driven by different frequencies that, for example, are either directly switched to the respective antenna feed elements 14, or switched via an associated switching network 48 having a plurality of inputs 50, at least some of which are connected to different feed signals 58.

Figure 5:
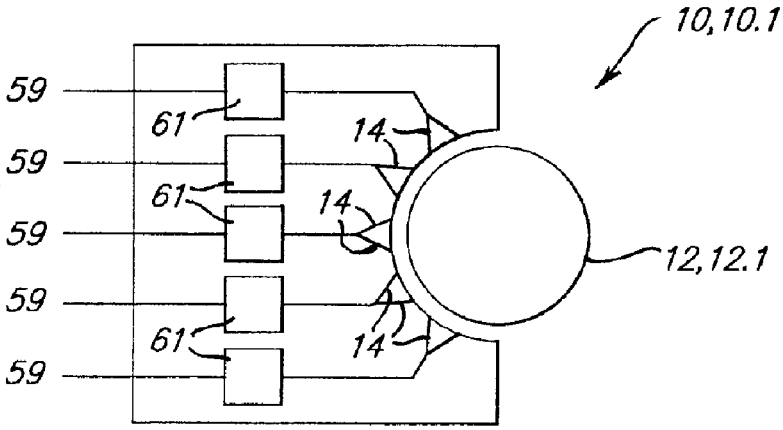
FIG. 5 illustrates an embodiment of a multi-beam antenna, wherein each antenna feed element is operatively coupled to a separate signal.

Referring to FIG. 5, the multi-beam antenna 10, 10.1 may be adapted so that the respective signals are associated with the respective antenna feed elements 14 in a one-to-one relationship, thereby precluding the need for an associated switching network 48. For example, each antenna feed element 14 can be operatively connected to an associated signal 59 through an associated processing element 61. As one example, with the multi-beam antenna 10, 10.1 configured as an imaging array, the respective antenna feed elements 14 are used to receive electromagnetic energy, and the respective processing elements 61 comprise detectors. As another example, with the multi-beam antenna 10, 10.1 configured as a communication antenna, the respective antenna feed elements 14 are used to both transmit and receive electromagnetic energy, and the respective processing elements 61 comprise transmit/receive modules or transceivers.

Figure 6:
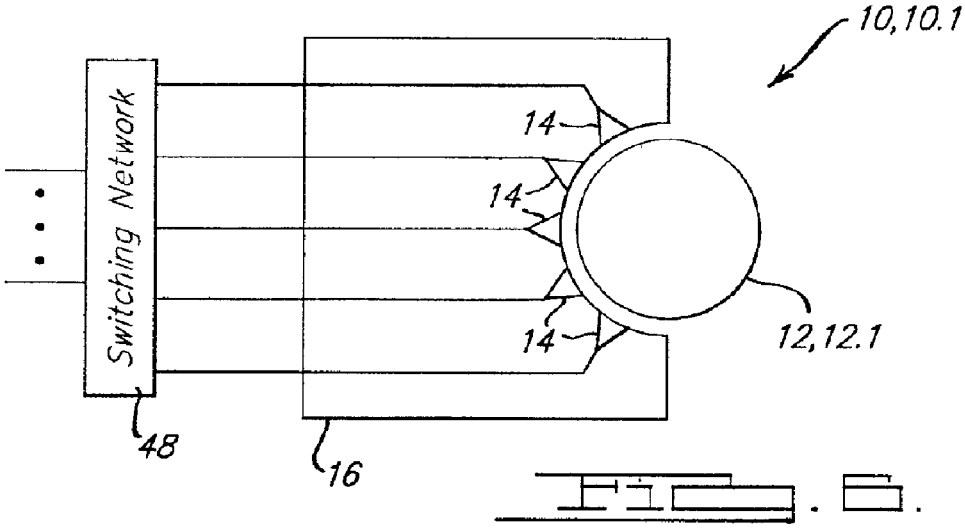
FIG. 6 illustrates an embodiment of a multi-beam antenna, wherein the associated switching network is separately located from the dielectric substrate.

Referring to FIG. 6, the switching network 48, if used, need not be collocated on a common dielectric substrate 16, but can be separately located, as, for example, may be useful for low frequency applications, for example, for operating frequencies less than 20 GHz, e.g. 1-20 GHz.

Figure 7:
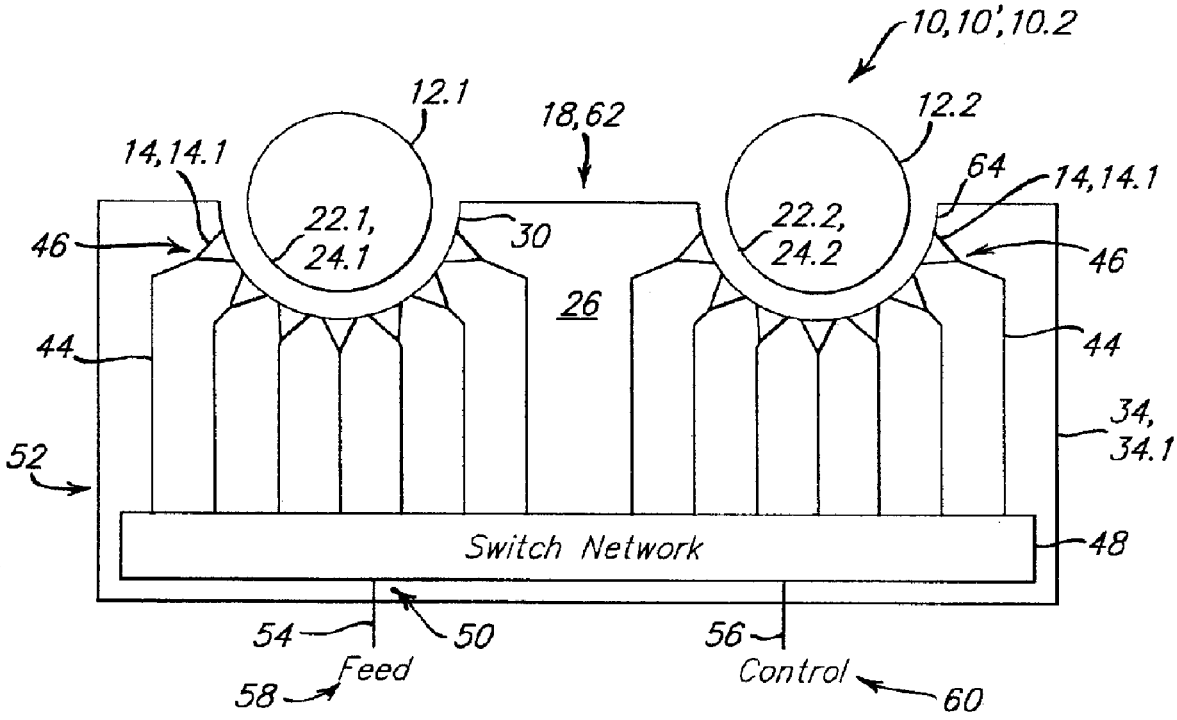
FIG. 7 illustrates a top view of a second embodiment of a multi-beam antenna comprising a plurality of electromagnetic lenses located proximate to one edge of a dielectric substrate.
Figure 8:
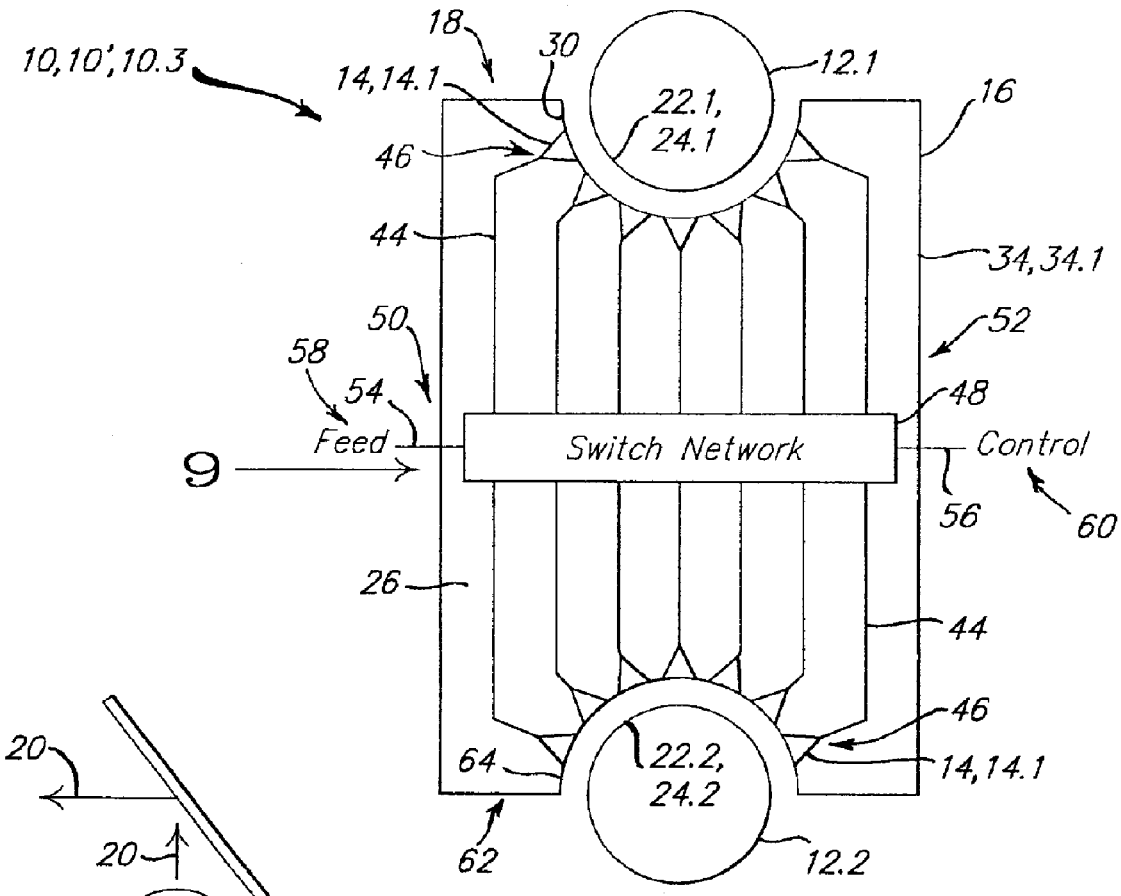
FIG. 8 illustrates a top view of a third embodiment of a multi-beam antenna comprising a plurality of electromagnetic lenses located proximate to opposite edges of a dielectric substrate.
Figure 9:
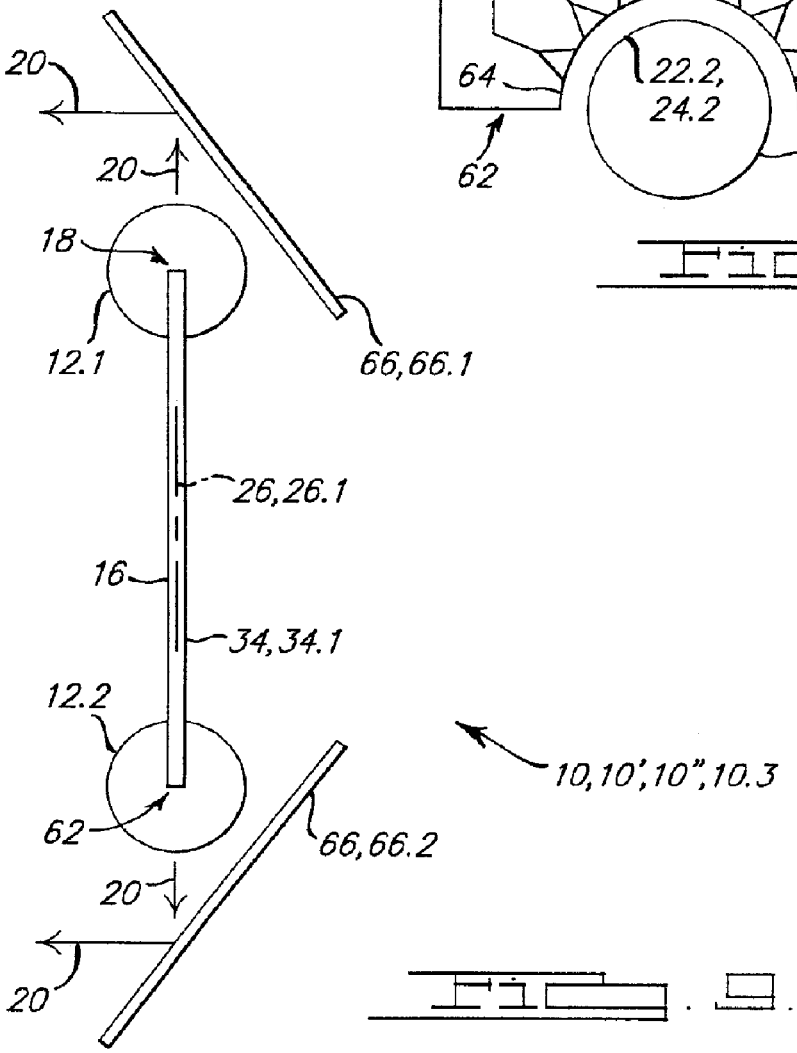
FIG. 9 illustrates a side view of the third embodiment illustrated in FIG. 8, further comprising a plurality of reflectors.

Referring to FIGS. 7, 8 and 9, in accordance with a second aspect, a multi-beam antenna 10' comprises at least first 12.1 and second 12.2 electromagnetic lenses, each having a first side 22.1, 22.2 with a corresponding first contour 24.1, 24.2 at an intersection of the respective first side 22.1, 22.2 with the reference surface 26. The dielectric substrate 16 comprises at least a second edge 62 comprising a third contour 64, wherein the second contour 30 is proximate to the first contour 24.1 of the first electromagnetic lens 12.1 and the third contour 64 is proximate to the first contour 24.2 of the second electromagnetic lens 12.2.

Referring to FIG. 7, in accordance with a second embodiment of the multi-beam antenna 10.2, the second edge 62 is the same as the first edge 18 and the second 30 and third 64 contours are displaced from one another along the first edge 18 of the dielectric substrate 16.

Referring to FIG. 8, in accordance with a third embodiment of the multi-beam antenna 10.3, the second edge 62 is different from the first edge 18, and more particularly is opposite to the first edge 18 of the dielectric substrate 16.

Referring to FIG. 9, in accordance with a third aspect, a multi-beam antenna 10" comprises at least one reflector 66, wherein the reference surface 26 intersects the at least one reflector 66 and one of the at least one electromagnetic lens 12 is located between the dielectric substrate 16 and the reflector 66. The at least one reflector 66 is adapted to reflect electromagnetic energy propagated through the at least one electromagnetic lens 12 after being generated by at least one of the plurality of antenna feed elements 14. In accordance with the third aspect, the third embodiment of the multi-beam antenna 10.3 can further cooperates with at least first 66.1 and second 66.2 reflectors, wherein the first electromagnetic lens 12.1 is located between the dielectric substrate 16 and the first reflector 66.1, the second electromagnetic lens 12.2 is located between the dielectric substrate 16 and the second reflector 66.2, the first reflector 66.1 is adapted to reflect electromagnetic energy propagated through the first electromagnetic lens 12.1 after being generated by at least one of the plurality of antenna feed elements 14 on the second contour 30, and the second reflector 66.2 is adapted to reflect electromagnetic energy propagated through the second electromagnetic lens 12.2 after being generated by at least one of the plurality of antenna feed elements 14 on the third contour 64. For example, the first 66.1 and second 66.2 reflectors may be oriented to direct the beams of electromagnetic energy 20 from each side in a common nominal direction, as illustrated in FIG. 9. Referring to FIG. 9, the multi-beam antenna 10" as illustrated would provide for scanning in a direction normal to the plane of the illustration. If the dielectric substrate 16 were rotated by 90 degrees with respect to the reflectors 66.1, 66.2, about an axis connecting the respective electromagnetic lenses 12.1, 12.2, then the multi-beam antenna 10" would provide for scanning in a direction parallel to the plane of the illustration.

Figure 10:
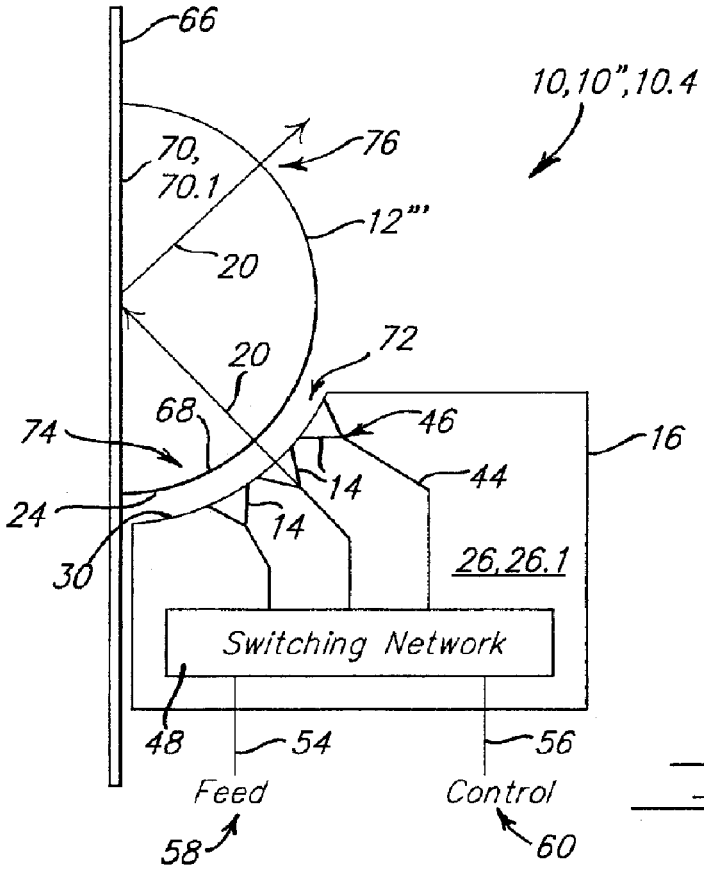
FIG. 10 illustrates a fourth embodiment of a multi-beam antenna, comprising an electromagnetic lens and a reflector.

Referring to FIG. 10, in accordance with the third aspect and a fourth embodiment, a multi-beam antenna 10", 10.4 comprises an at least partially spherical electromagnetic lens 12'", for example, a hemispherical electromagnetic lens, having a curved surface 68 and a boundary 70, for example a flat boundary 70.1. The multi-beam antenna 10", 10.4 further comprises a reflector 66 proximate to the boundary 70, and a plurality of antenna feed elements 14 on a dielectric substrate 16 proximate to a contoured edge 72 thereof, wherein each of the antenna feed elements 14 is adapted to radiate one of a respective plurality of beams of electromagnetic energy 20 into a first sector 74 of the electromagnetic lens 12'". The electromagnetic lens 12'" has a first contour 24 at an intersection of the first sector 74 with a reference surface 26, for example, a plane 26.1. The contoured edge 72 has a second contour 30 located on the reference surface 26 that is proximate to the first contour 24 of the first sector 74. The multi-beam antenna 10", 10.4 further comprises a switching network 48 and a plurality of transmission lines 44 operatively connected to the antenna feed elements 14 as described hereinabove for the other embodiments.

In operation, at least one feed signal 58 applied to a corporate antenna feed port 54 is either blocked, or switched to the associated feed port 46 of one or more antenna feed elements 14, via one or more associated transmission lines 44, by the switching network 48 responsive to a control signal 60 applied to a control port 56 of the switching network 48. Each antenna feed element 14 to which the feed signal 58 is applied launches an associated electromagnetic wave into the first sector 74 of the associated electromagnetic lens 12'". The electromagnetic wave propagates through—and is diffracted by—the curved surface 68, and is then reflected by the reflector 66 proximate to the boundary 70, whereafter the reflected electromagnetic wave propagates through the electromagnetic lens 12'" and exits—and is diffracted by—a second sector 76 as an associated beam of electromagnetic energy 20. With the reflector 66 substantially normal to the reference surface 26—as illustrated in FIG. 10—the different beams of electromagnetic energy 20 are directed by the associated antenna feed elements 14 in different directions that are nominally substantially parallel to the reference surface 26.

Figure 11:
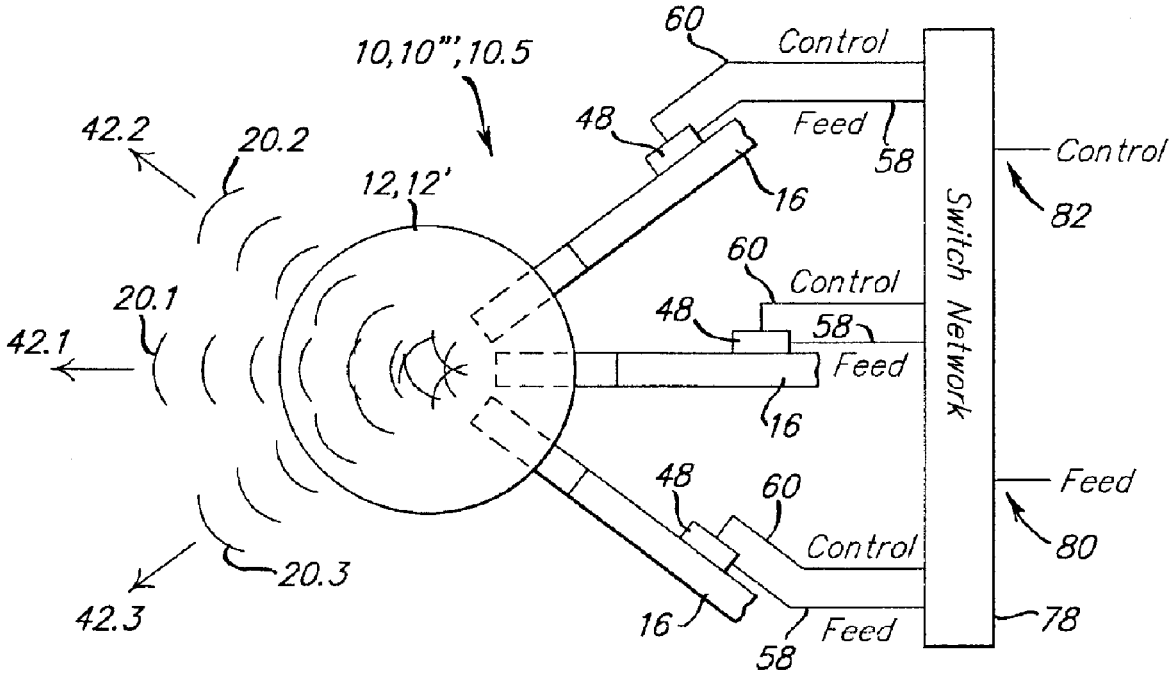
FIG. 11 illustrates a fifth embodiment of a multi-beam antenna.

Referring to FIG. 11, in accordance with a fourth aspect and a fifth embodiment, a multi-beam antenna 10''', 10.5 comprises an electromagnetic lens 12 and plurality of dielectric substrates 16, each comprising a set of antenna feed elements 14 and operating in accordance with the description hereinabove. Each set of antenna feed elements 14 generates (or is capable of generating) an associated set of beams of electromagnetic energy 20.1, 20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 having associated feed 80 and control 82 ports, each comprising at least one associated signal. Accordingly, the multi-beam antenna 10''', 10.5 provides for transmitting or receiving one or more beams of electromagnetic energy over a three-dimensional space.

The multi-beam antenna 10 provides for a relatively wide field-of-view, and is suitable for a variety of applications, including but not limited to automotive radar, point-to-point communications systems and point-to-multi-point communication systems, over a wide range of frequencies for which the antenna feed elements 14 may be designed to radiate, for example, frequencies in the range of 1 to 200 GHz. Moreover, the multi-beam antenna 10 may be configured for either mono-static or bi-static operation.

When a relatively narrow beamwidth, i.e. a high gain, is desired at a relatively lower frequency, a dielectric electromagnetic lens 12 can become relatively large and heavy. Generally, for these and other operating frequencies, the dielectric electromagnetic lens 12 may be replaced with a discrete lens array 100, e.g. a planar lens 100.1, which can beneficially provide for setting the polarization, the ratio of focal length to diameter, and the focal surface shape, and can be more readily be made to conform to a surface. A discrete lens array 100 can also be adapted to incorporate amplitude weighting so as to provide for control of sidelobes in the associates beams of electromagnetic energy 20.

Figure 12:
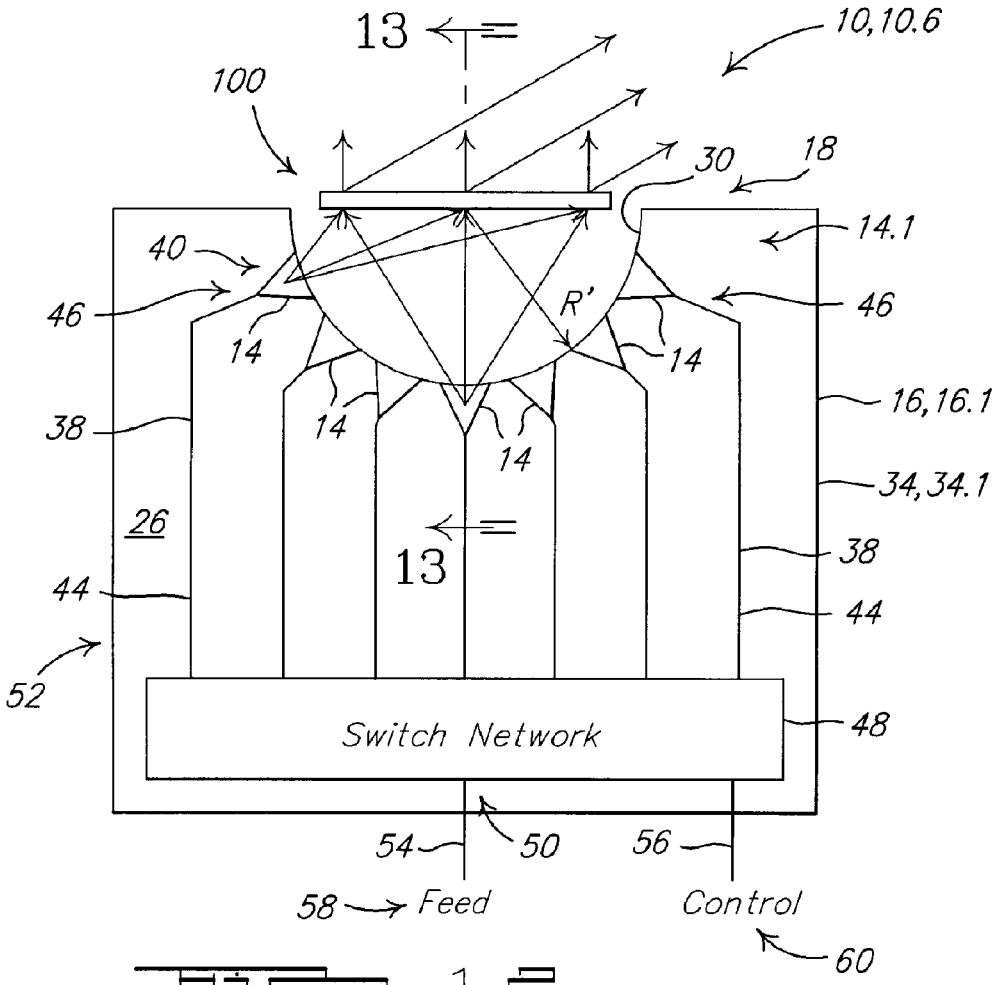
FIG. 12 illustrates a top view of a sixth embodiment of a multi-beam antenna comprising a discrete lens array.
Figure 13:
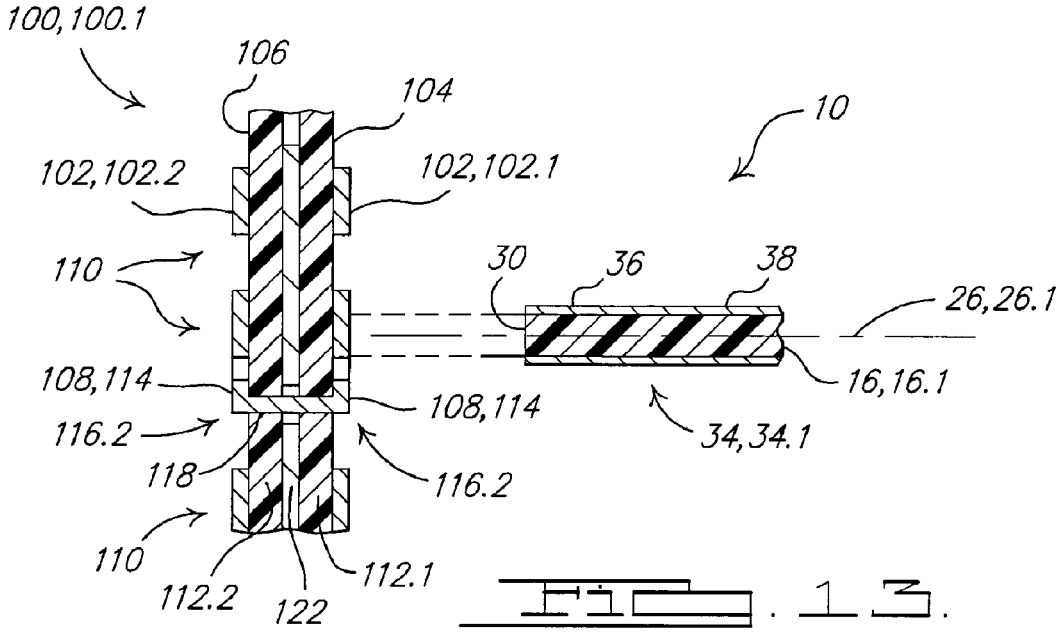
FIG. 13 illustrates a fragmentary side cross-sectional view of the embodiment illustrated in FIG. 12.
Figure 14:
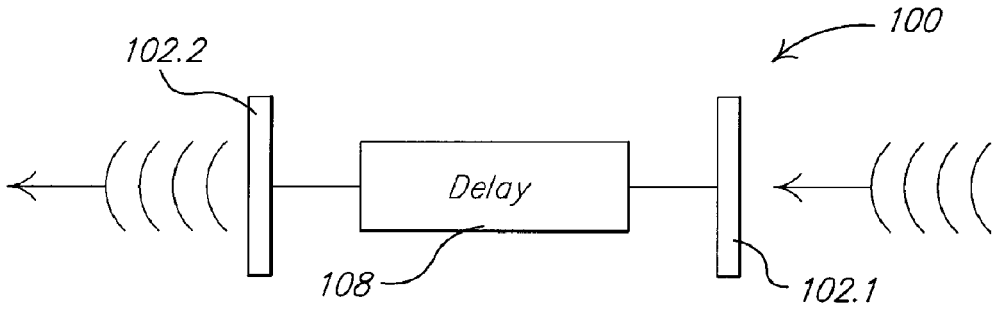
FIG. 14 illustrates a block diagram of a discrete lens array.

For example, referring to FIGS. 12 and 13, in accordance with the first aspect and a sixth embodiment of a multi-beam antenna 10, 10.6, the dielectric electromagnetic lens 12 of the first embodiment of the multi-beam antenna 10, 10.1 illustrated in FIGS. 1 and 2 is replaced with a planar lens 100.1 comprising a first set of patch antennas 102.1 on a first side 104 of the planar lens 100.1, and a second set of patch antennas 102.2 on the second side 106 of the planar lens 100.1, where the first 104 and second 106 sides are opposite one another. The individual patch antennas 102 of the first 102.1 and second 102.2 sets of patch antennas are in one-to-one correspondence. Referring to FIG. 14, each patch antenna 102, 102.1 on the first side 104 of the planar lens 100.1 is operatively coupled via a delay element 108 to a corresponding patch antenna 102, 102.2 on the second side 106 of the planar lens 100.1, wherein the patch antenna 102, 102.1 on the first side 104 of the planar lens 100.1 is substantially aligned with the corresponding patch antenna 102, 102.2 on the second side 106 of the planar lens 100.1.

In operation, electromagnetic energy that is radiated upon one of the patch antennas 102, e.g. a first patch antenna 102.1 on the first side 104 of the planar lens 100.1, is received thereby, and a signal responsive thereto is coupled via—and delayed by—the delay element 108 to the corresponding patch antenna 102, e.g. the second patch antenna 102.2, wherein the amount of delay by the delay element 108 is dependent upon the location of the corresponding patch antennas 102 on the respective first 104 and second 106 sides of the planar lens 100.1. The signal coupled to the second patch antenna 102.2 is then radiated thereby from the second side 106 of the planar lens 100.1. Stated in another way, the planar lens 100.1 comprises a plurality of lens elements 110, wherein each lens element 110 comprises a first patch antenna element 102.1 operatively coupled to a corresponding second patch antenna element 102.2 via at least one delay element 108, wherein the first 102.1 and second 102.2 patch antenna elements are substantially opposed to one another on opposite sides of the planar lens 100.1.

Figure 15A:
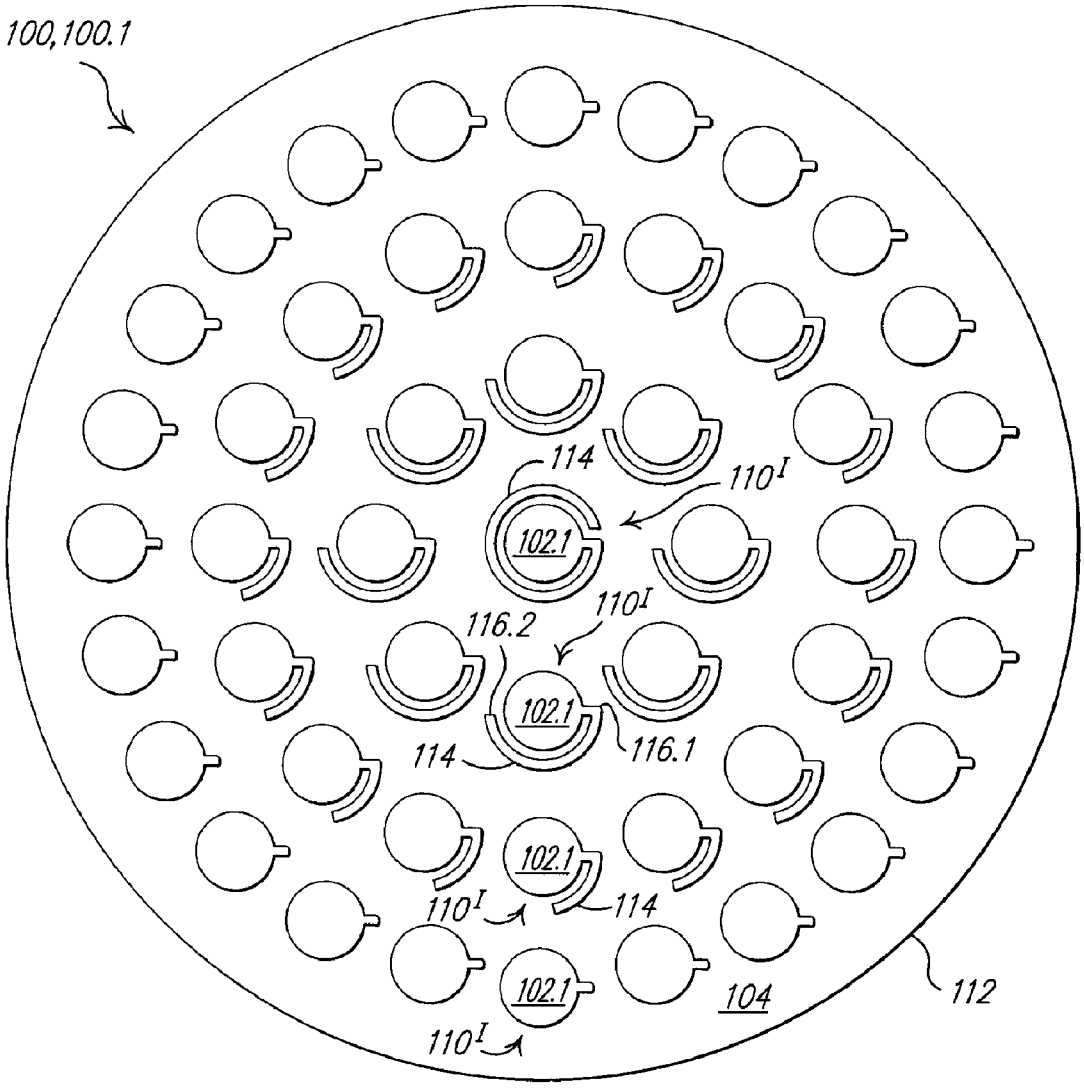
FIG. 15*a* illustrates a first side of one embodiment of a planar discrete lens array.
Figure 15B:
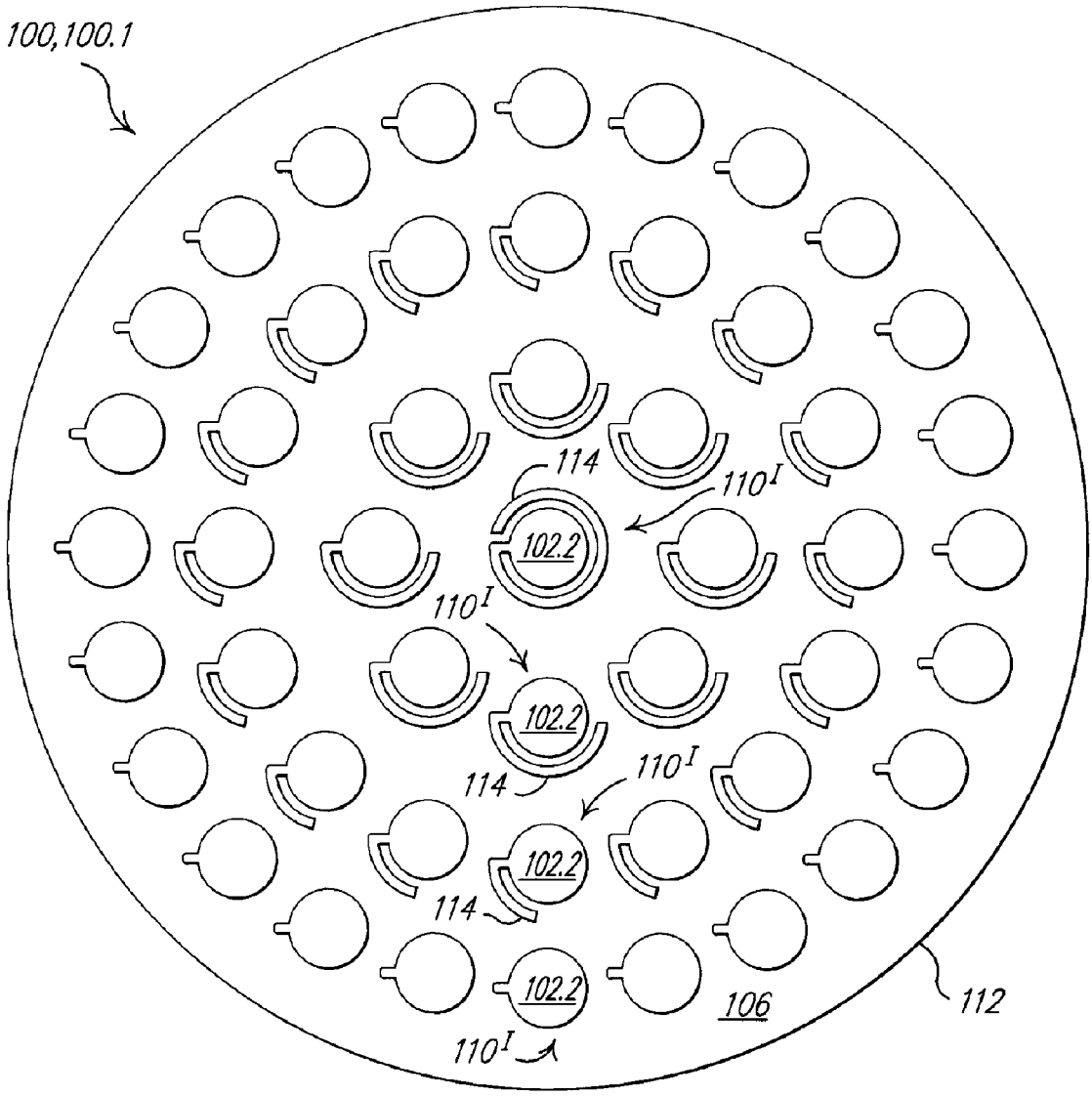
FIG. 15*b* illustrates a second side of one embodiment of a planar discrete lens array.
Figure 17:
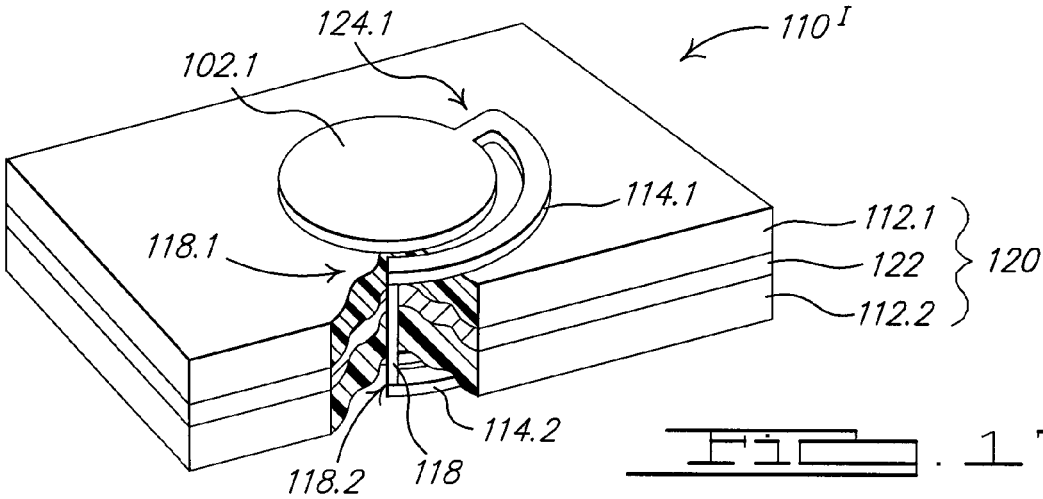
FIG. 17 illustrates a fragmentary cross sectional isometric view of a first embodiment of a discrete lens antenna element.
Figure 18:
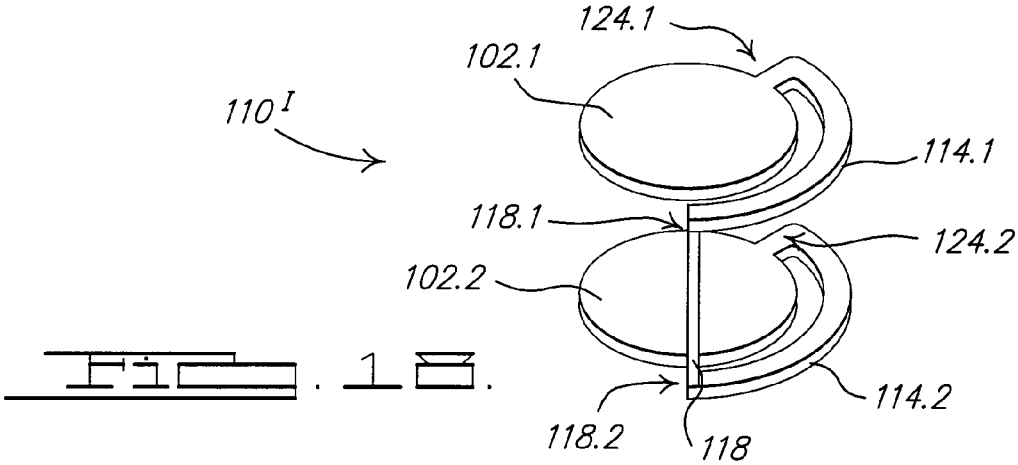
FIG. 18 illustrates an isometric view of the first embodiment of a discrete lens antenna element illustrated in FIG. 17, isolated from associated dielectric substrates.

Referring also to FIGS. 15*a* and 15*b*, in a first embodiment of a planar lens 100.1, the patch antennas 102.1, 102.2 comprise conductive surfaces on a dielectric substrate 112, and the delay element 108 coupling the patch antennas 102.1, 102.2 of the first 104 and second 106 sides of the planar lens 100.1 comprise delay lines 114, e.g. microstrip or stripline structures, that are located adjacent to the associated patch antennas 102.1, 102.2 on the underlying dielectric substrate 112. Referring also to FIGS. 17 and 18, the first ends 116.1 of the delay lines 114 are connected to the corresponding patch antennas 102.1, 102.2, and the second ends 116.2 of the delay lines 114 are interconnected to one another with a conductive path, for example, with a conductive via 118 though the dielectric substrate 112. FIGS. 15*a* and 15*b* illustrate the delay lines 114 arranged so as to provide for feeding the associated first 102.1 and second 102.2 sets of patch antennas at the same relative locations.

Figure 16:
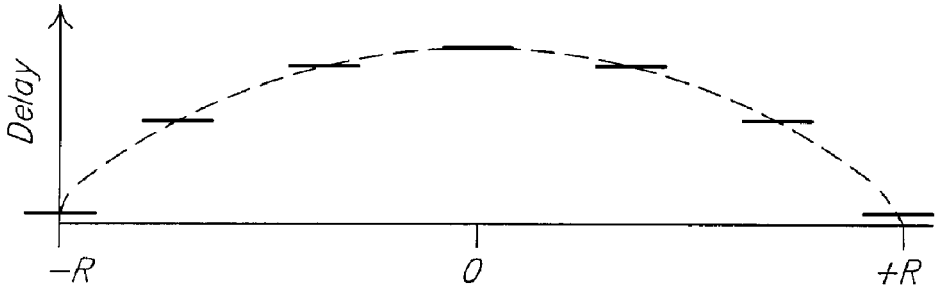
FIG. 16 illustrates a plot of delay as a function of radial location on the planar discrete array illustrated in FIGS. 15*a* and 15*b;*

Referring to FIG. 16, the amount of delay caused by the associated delay elements 108 is made dependent upon the location of the associated patch antenna 102 in the planar lens 100.1, and, for example, is set by the length of the associated delay lines 114, as illustrated by the configuration illustrated in FIGS. 15*a*, 15*b*, 17 and 18, so as to emulate the phase properties of a convex electromagnetic lens 12, e.g. a spherical lens 12'. The shape of the delay profile illustrated in FIG. 16 can be of various configurations, for example, 1) uniform for all radial directions, thereby emulating a spherical lens 12'; 2) adapted to incorporate an azimuthal dependence, e.g. so as to emulate an elliptical lens; or 3) adapted to provide for focusing in one direction only, e.g. in the elevation plane of the multi-beam antenna 10.6, e.g. so as to emulate a cylindrical lens.

Referring to FIGS. 17 and 18, a first embodiment of a lens element 110*I* of the planar lens 100.1 illustrated in FIGS. 15*a* and 15*b* comprises first 102.1 and second 102.2 patch antenna elements on the outer surfaces of a core assembly 120 comprising first 112.1 and second 112.2 dielectric substrates on both sides of a conductive ground plane 122 sandwiched therebetween. A first delay line 114.1 on the first side 104 of the planar lens 100.1 extends circumferentially from a first location 124.1 on the periphery of the first patch antenna element 102.1 to a first end 118.1 of a conductive via 118 extending through the core assembly 120, and a second delay line 114.2 on the second side 106 of the planar lens 100.1 extends circumferentially from a second location 124.2 on the periphery of the second patch antenna element 102.2 to a second end 118.2 of the conductive via 118. Accordingly, the combination of the first 114.1 and second 114.2 delay lines interconnected by the conductive via 118 constitutes the associated delay element 108 of the lens element 110*I*, and the amount of delay of the delay element 108 is generally responsive to the cumulative circumferential lengths of the associated first 114.1 and second 114.2 delay lines and the conductive via 118. For example, the delay element 108 may comprise at least one transmission line comprising either a stripline, a microstrip line, an inverted microstrip line, a slotline, an image line, an insulated image line, a tapped image line, a coplanar stripline, or a coplanar waveguide line formed on the dielectric substrate(s) 112, 112.1, 112.2, for example, from a printed circuit board, for example, by subtractive technology, for example, chemical or ion etching, or stamping; or additive techniques, for example, deposition, bonding or lamination.

Figure 19:
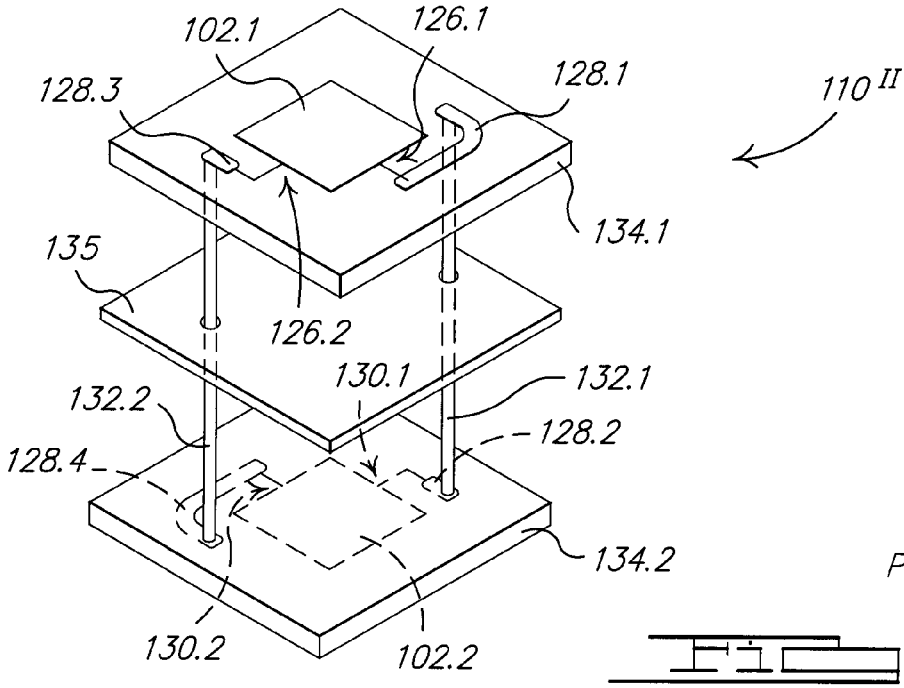
Prior Art FIG. 19.
FIG. 19 illustrates an isometric view of a second embodiment of a discrete lens antenna element.

Referring to FIG. 19, in accordance with a second embodiment of a lens element $110^{II}$ of the planar lens 100.1, the first 102.1 and second 102.2 patch antenna elements may be interconnected with one another so as to provide for dual polarization, for example, as disclosed in the technical paper "Multibeam Antennas with Polarization and Angle Diversity" by Darko Popovic and Zoya Popovic in *IEEE Transactions on Antenna and Propagation*, Vol. 50, No. 5, May 2002, which is incorporated herein by reference. A first location 126.1 on an edge of the first patch antenna element 102.1 is connected via first 128.1 and second 128.2 delay lines to a first location 130.1 on the second patch antenna element 102.2, and a second location 126.2 on an edge of the first patch antenna element 102.1 is connected via third 128.3 and fourth 128.4 delay lines to a second location 130.2 on the second patch antenna element 102.2, wherein, for example, the first 126.1 and second 126.2 locations on the first patch antenna element 102.1 are substantially orthogonal with respect to one another, as are the corresponding first 130.1 and second 130.2 locations on the second patch antenna element 102.2. The first 128.1 and second 128.2 delay lines are interconnected with a first conductive via 132.1 that extends through associated first 134.1 and second 134.2 dielectric substrates and through a conductive ground plane 135 located therebetween. Similarly, the third 128.3 and fourth 128.4 delay lines are interconnected with a second conductive via 132.2 that also extends through the associated first 134.1 and second 134.2 dielectric substrates and through the conductive ground plane 135. In the embodiment illustrated in FIG. 19, the first location 126.1 on the first patch antenna element 102.1 is shown substantially orthogonal to the first location 130.1 on the second patch antenna element 102.2 so that the polarization of the radiation from the second patch antenna element 102.2 is orthogonal with respect to that of the radiation incident upon the first patch antenna element 102.1. However, it should be understood that the first locations 126.1 and 130.1 could be aligned with one another, or could be oriented at some other angle with respect to one another.

Figure 20:
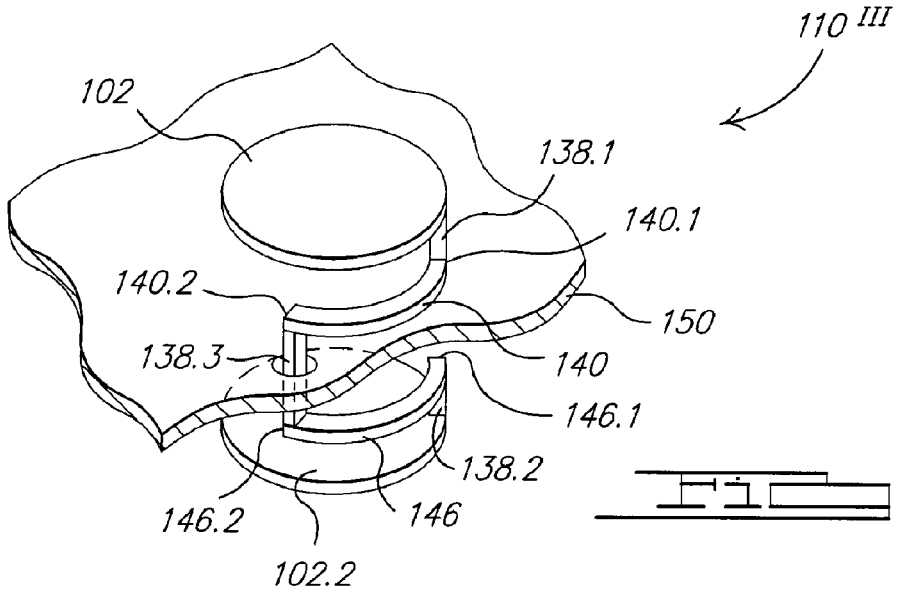
FIG. 20 illustrates an isometric view of a third embodiment of a discrete lens antenna element, isolated from associated dielectric substrates.
Figure 21:
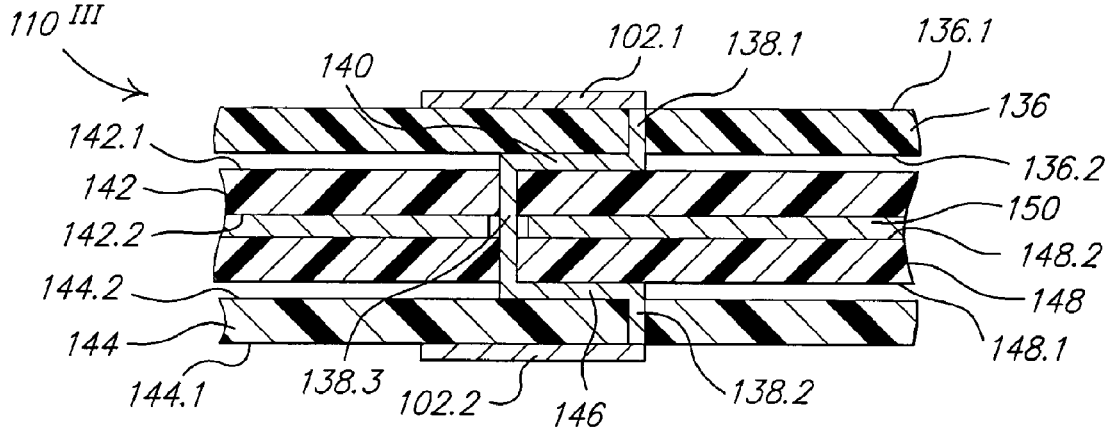
FIG. 21 illustrates a cross sectional view of the third embodiment of the discrete lens antenna element.

Referring to FIGS. 20 and 21, in accordance with a third embodiment of a lens element $110^{III}$ of the planar lens 100.1, one or more delay lines 114 may be located between the first 102.1 and second 102.2 patch antenna elements—rather than adjacent thereto as in the first and second embodiments of the lens element $110^{I}$, $110^{II}$—so that the delay lines 114 are shadowed by the associated first 102.1 and second 102.2 patch antenna elements. For example, in one embodiment, the first patch antenna element 102.1 on a first side 136.1 of a first dielectric substrate 136 is connected with a first conductive via 138.1 through the first dielectric substrate 136 to a first end 140.1 of a first delay line 140 located between the second side 136.2 of the first dielectric substrate 136 and a first side 142.1 of a second dielectric substrate 142. Similarly, the second patch antenna element 102.2 on a first side 144.1 of a third dielectric substrate 144 is connected with a second conductive via 138.2 through the third dielectric substrate 144 to a first end 146.1 of a second delay line 146 located between the second side 144.2 of the third dielectric substrate 144 and a first side 148.1 of a fourth dielectric substrate 148. A third conductive via 138.3 interconnects the second ends 140.2, 146.2 of the first 140 and second 146 delay lines, and extends through the second 142 and fourth 148 dielectric substrates, and through a conductive ground plane 150 located between the second sides 142.2, 148.2 of the second 142 and fourth 148 dielectric substrates. The first 140 and second 146 delay lines are shadowed by the first 102.1 and second 102.2 patch antenna elements, and therefore do not substantially affect the respective radiation patterns of the first 102.1 and second 102.2 patch antenna elements.

Figure 22:
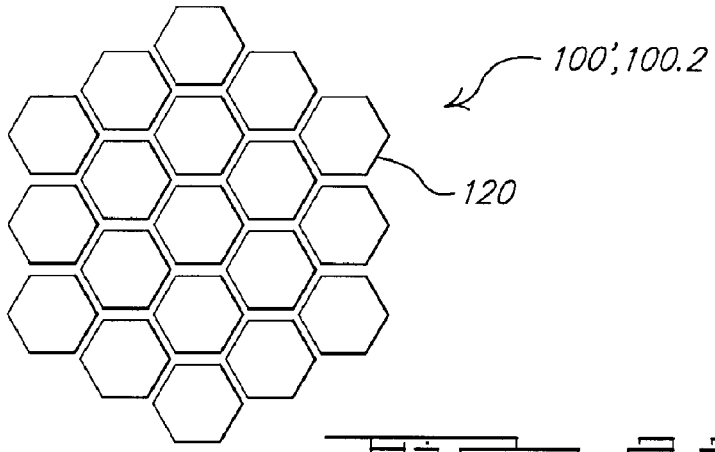
FIG. 22 illustrates a plan view of a second embodiment of a discrete lens array.

Referring to FIG. 22, in accordance with a second embodiment of a planar lens 100.2, the patch antennas 102 are hexagonally shaped so as to provide for a more densely packed discrete lens array 100'. The particular shape of the individual patch antennas 102 is not limiting, and for example, can be circular, rectangular, square, triangular, pentagonal, hexagonal, or some other polygonal shape or an arbitrary shape.

Notwithstanding that FIGS. 13, 15*a*, 15*b*, and 17-21 illustrate a plurality of delay lines 114.1, 114.2, 128.1, 128.2, 128.3, 128.4, 140, 146 interconnecting the first 102.1 and second 102.2 patch antenna elements, it should be understood that a single delay line 114—e.g. located on a surface of one of the dielectric substrates 112, 134, 136, 142, 144. 148—could be used, interconnected to the first 102.1 and second 102.2 patch antenna elements with associated conductive paths.

Figure 23:
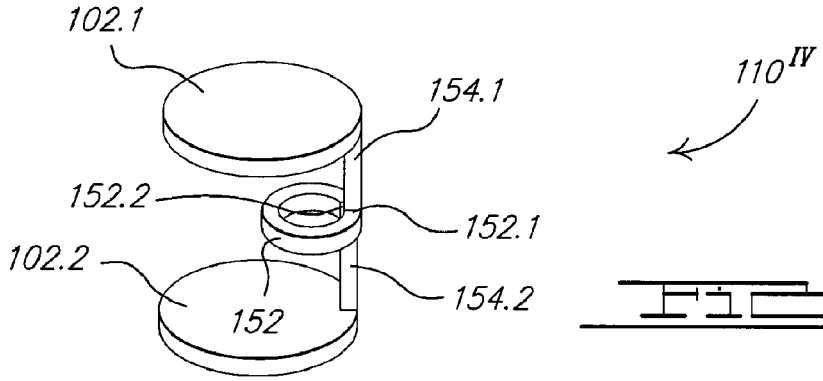
FIG. 23 illustrates an isometric view of a fourth embodiment of a discrete lens antenna element, isolated from associated dielectric substrates.
Figure 24A:
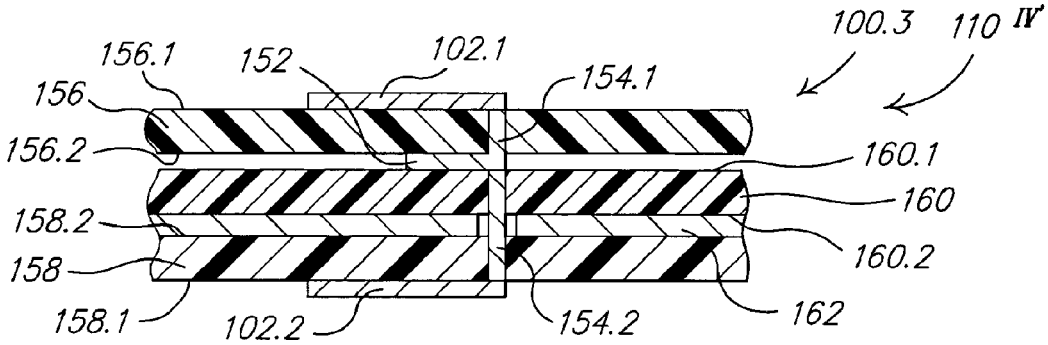
FIG. 24*a* illustrates a cross sectional view of the fourth embodiment of the discrete lens antenna element of a third embodiment of a discrete lens array.
Figure 24B:
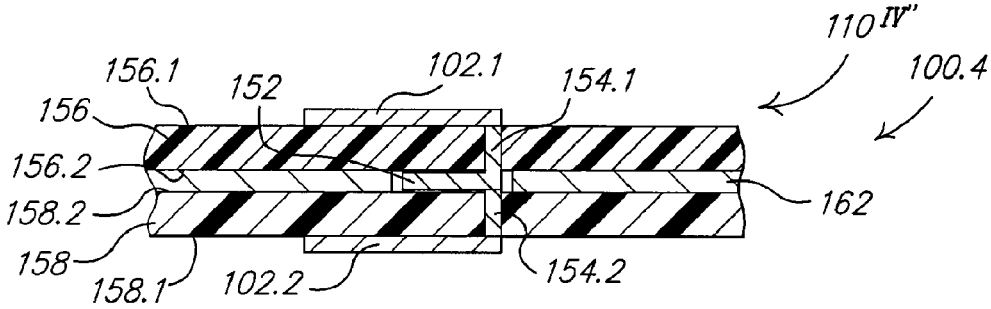
FIG. 24*b* illustrates a cross sectional view of the fourth embodiment of a discrete lens antenna element of a fourth embodiment of a discrete lens array.

Referring to FIGS. 23, 24*a* and 24*b*, in accordance with a fourth embodiment of a lens element $110^{IV}$ of the planar lens 100.1, the first 102.1 and second 102.2 patch antenna elements are interconnected with a delay line 152 located therebetweeen, wherein a first end 152.1 of the delay line 152 is connected with a first conductive via 154.1 to the first patch antenna element 102.1 and a second end 152.2 of the delay line 152 is connected with a second conductive via 154.2 to the second patch antenna element 102.2. Referring to FIG. 24*a*, in accordance with a third embodiment of a planar lens 100.3 incorporating the fourth embodiment of the lens element $110^{IV'}$, the first patch antenna element 102.1 is located on a first side 156.1 of a first dielectric substrate 156, and the second patch antenna element 102.2 is located on a first side 158.1 of a second dielectric substrate 158. The delay line 152 is located between the second side 156.2 of the first dielectric substrate 156 and a first side 160.1 of a third dielectric substrate 160 and the first conductive via 154.1 extends through the first dielectric substrate 156. A conductive ground plane 162 is located between the second sides 158.2, 160.2 of the second 158 and third 160 dielectric substrates, respectively, and the second conductive via 154.2 extends through the second 158 and third 160 dielectric substrates and through the conductive ground plane 162. Referring to FIG. 24*b*, a fourth embodiment of a planar lens 100.4 incorporates the fourth embodiment of a lens element $110^{IV''}$ illustrated in FIG. 23, without the third dielectric substrate 160 of the third embodiment of the planar lens 100.3 illustrated in FIG. 24*a*, wherein the delay line 152 and the conductive ground plane 162 are coplanar between the second sides 156.2, 158.2 of the first 156 and second 158 dielectric substrates, and are insulated or separated from one another.

The discrete lens array 100 does not necessarily have to incorporate a conductive ground plane 122, 135, 150, 162.

For example, in the fourth embodiment of a planar lens 100.4 illustrated in FIG. 24*b*, the conductive ground plane 162 is optional, particularly if a closely packed array of patch antennas 102 were used as illustrated in FIG. 22. Furthermore, the first embodiment of a lens element 110$^{I}$ illustrated in FIG. 18 could be constructed with the first 102.1 and second 102.2 patch antenna elements on opposing sides of a single dielectric substrate 112.

Figure 25:
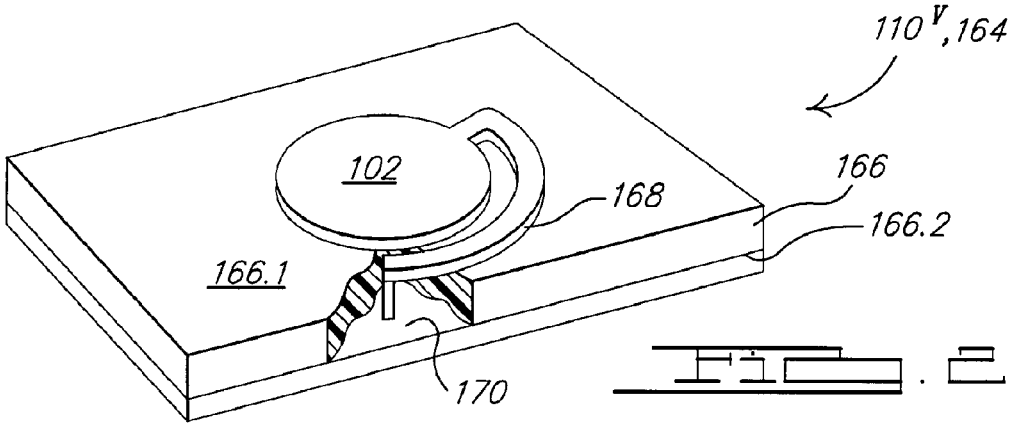
FIG. 25 illustrates a fragmentary cross sectional isometric view of a fifth embodiment of a discrete lens antenna element of a reflective discrete lens array.
Figure 26:
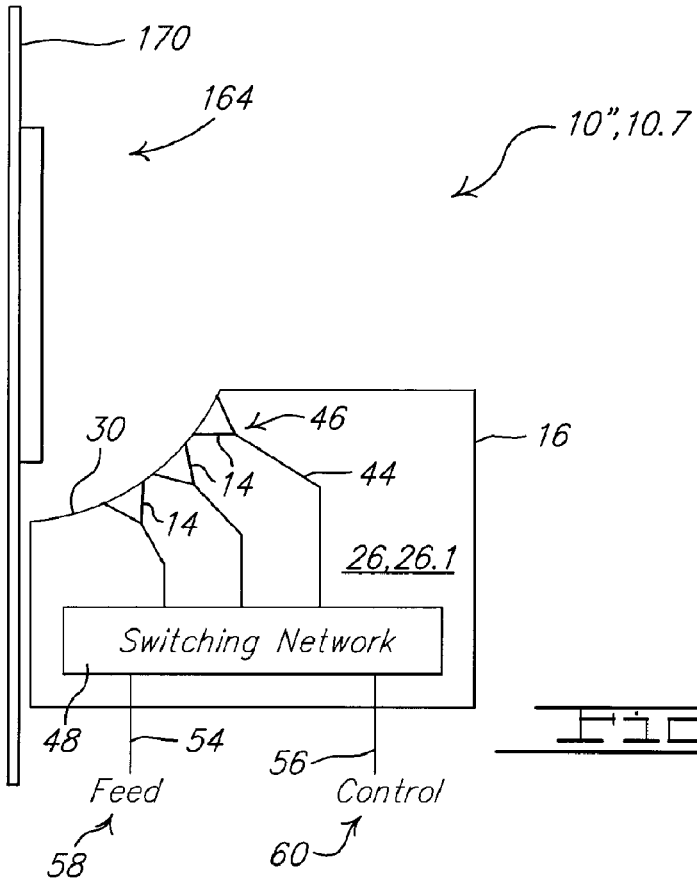
FIG. 26 illustrates a seventh embodiment of a multi-beam antenna, comprising a discrete lens array and a reflector.

Referring to FIGS. 25 and 26, in accordance with the third aspect and a seventh embodiment of a multi-beam antenna 10", 10.7, and a fifth embodiment of a lens element 110$^{V}$ illustrated in FIG. 26, a reflective discrete lens array 164 comprises a plurality of patch antennas 102 located on a first side 166.1 of a dielectric substrate 166 and connected via corresponding delay lines 168 that are terminated either with an open or short circuit, e.g. by termination at an associated conductive ground plane 170 on the second side 166.2 of the dielectric substrate 166, wherein the associated delays of the delay lines 168 are adapted—for example, as illustrated in FIG. 16—so as to provide a phase profile that emulates a dielectric lens, e.g. a dielectric electromagnetic lens 12'" as illustrated in FIG. 10 Accordingly, the reflective discrete lens array 164 acts as a reflector and provides for receiving electromagnetic energy in the associated patch antennas 102, and then reradiating the electromagnetic energy from the patch antennas 102 after an associated location dependent delay, so as to provide for focusing the reradiated electromagnetic energy in a desired direction responsive to the synthetic structure formed by the phase front of the reradiated electromagnetic energy responsive to the location dependent delay lines.

In the sixth embodiment of the multi-beam antenna 10.6 illustrated in FIG. 12, and a seventh embodiment of a multi-beam antenna 10.7 illustrated in FIG. 26, which correspond in operation to the first and fourth embodiments of the multi-beam antenna 10.1, 10.4 illustrated in FIGS. 1 and 10 respectively, the discrete lens array 100, 164 is adapted to cooperate with a plurality of antenna feed elements 14, e.g. end-fire antenna element 14.1 located along the edge of a dielectric substrate 16 having an edge contour 30 adapted to cooperate with the focal surface of the associated discrete lens array 100, 164, wherein the antenna feed elements 14 are fed with a feed signal 58 coupled thereto through an associated switching network 48, whereby one or a combination of antenna feed elements 14 may be fed so as to provide for one or more beams of electromagnetic energy 20, the direction of which can be controlled responsive to a control signal 60 applied to the switching network 48.

Figure 27:
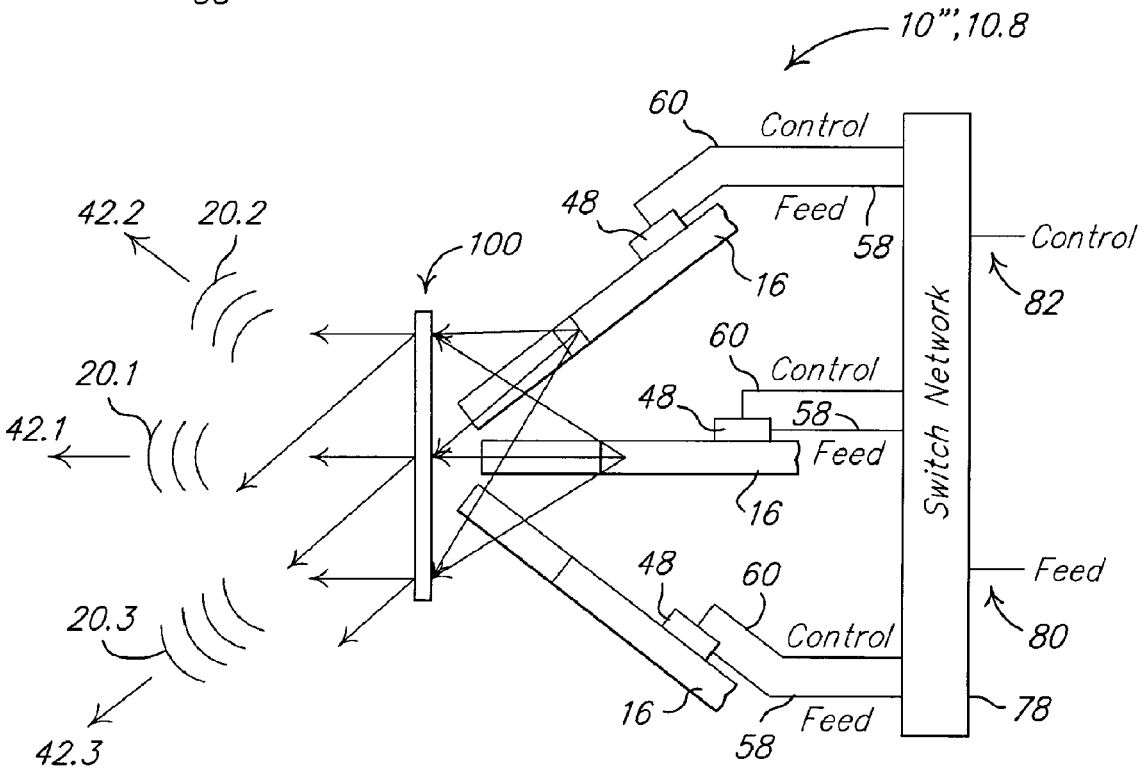
FIG. 27 illustrates an eighth embodiment of a multi-beam antenna.

Referring FIG. 27, in accordance with the fourth aspect and an eighth embodiment of a multi-beam antenna 10'", 10.8, which corresponds in operation to the fifth embodiment of the multi-beam antenna 10.5 illustrated in FIG. 11, the discrete lens array 100 can be adapted to cooperate with a plurality of dielectric substrates 16, each comprising a set of antenna feed elements 14 and operating in accordance with the description hereinabove. Each set of antenna feed elements 14 generates or receives (or is capable of generating or receiving) an associated set of beams of electromagnetic energy 20.1, 20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 having associated feed 80 and control 82 ports, each comprising at least one associated signal. Accordingly, the multi-beam antenna 10.8 provides for transmitting or receiving one or more beams of electromagnetic energy over a three-dimensional space.

Generally, because of reciprocity, any of the above-described antenna embodiments can be used for either transmission or reception or both transmission and reception of electromagnetic energy.

The discrete lens array 100, 164 in combination with planar, end-fire antenna elements 14.1 etched on a dielectric substrate 16 provides for a multi-beam antenna 10 that can be manufactured using planar construction techniques, wherein the associated antenna feed elements 14 and the associated lens elements 110 are respectively economically fabricated and mounted as respective groups, so as to provide for an antenna system that is relatively small and relatively light weight.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A multi-beam antenna, comprising:

a. an electromagnetic lens, wherein said electromagnetic lens comprises a nominal focal surface, and said nominal focal surface is curved;

b. a dielectric substrate in a cooperative relationship with said electromagnetic lens; and c. a plurality of antenna feed elements on said dielectric substrate at a corresponding plurality of locations and oriented in a corresponding plurality of directions, wherein at least two of said plurality of antenna elements are located at a corresponding at least two different locations, said at least two of said plurality of antenna elements are each adapted to act along a corresponding at least two different directions, and said at least two different directions and said at least two different locations are adapted in relation to said nominal focal surface of said electromagnetic lens so as to provide for at least one of transmitting and receiving a plurality of different electromagnetic beams in or from a plurality of different said directions in cooperation with said electromagnetic lens.

2. A multi-beam antenna as recited in claim 1, wherein said electromagnetic lens comprises a plurality of lens elements in a discrete lens array, wherein each said lens element comprises first and second conductive patch elements; at least one dielectric layer interposed between said first and second conductive patch elements, wherein said first conductive patch element is located on a first surface of said at least one dielectric layer, and said second conductive patch element is located on a second surface of said at least one dielectric layer; and at least one delay element operative between said first and second conductive patch elements; wherein said first and second conductive patch elements are located on respective first and second sides of said electromagnetic lens, said first side of said electromagnetic lens is adapted to be in electromagnetic wave communication with said plurality of antenna feed elements, said at least one delay element operative between said first and second conductive patch elements delays a propagation of an electromagnetic wave between said first and second conductive patch elements by a delay period, and said delay period of at least one of said electromagnetic lens elements is different from a delay period of at least another of said electromagnetic lens elements.

3. A multi-beam antenna as recited in claim 2, wherein said at least one dielectric layer comprises a single dielectric layer, said first and second surfaces are on opposing surfaces of said single dielectric layer, said first surface faces said first side of said electromagnetic lens, and said second surface faces said second side of said electromagnetic lens.

4. A multi-beam antenna as recited in claim 2, wherein said at least one delay element comprises at least one transmission line that operates in cooperation with said at least one dielectric layer.

5. A multi-beam antenna as recited in claim 4, wherein a first end of said at least one transmission line is operatively coupled to said first conductive patch element, and a second end of said at least one transmission line is operatively coupled to said second conductive patch element.

6. A multi-beam antenna as recited in claim 5, wherein said at least one transmission line comprises a conductive interconnection through said at least one dielectric layer.

7. A multi-beam antenna as recited in claim 6, wherein said at least one transmission line is located on at least one of said first and second surfaces of said at least one dielectric layer.

8. A multi-beam antenna as recited in claim 7, wherein said at least one transmission line is located along a path that substantially follows a peripheral contour of at least one of said first and second conductive patch elements proximally adjacent to said at least one of said first and second conductive patch elements.

9. A multi-beam antenna as recited in claim 7, wherein said at least one transmission line comprises first and second transmission lines, a first end of said first transmission line is operatively coupled to said first conductive patch element at a first location, a second end of said first transmission line is operatively coupled to a first end of said conductive interconnection through said at least one dielectric layer, said first transmission line is operatively associated with said first surface of said at least one dielectric layer, a first end of said second transmission line is operatively coupled to said second conductive patch element at a second location, a second end of said second transmission line is operatively coupled to a second end of said conductive interconnection through said at least one dielectric layer, and said second transmission line is operatively associated with said second surface of said at least one dielectric layer.

10. A multi-beam antenna as recited in claim 9, wherein said first and second locations are substantially aligned in opposition to one another across said at least one dielectric layer.

11. A multi-beam antenna as recited in claim 2, wherein a first end of said at least one delay element is operatively coupled to said first conductive patch element at a first location, a second end of said at least one delay element is operatively coupled to said second conductive patch element at a second location, and said first and second locations are displaced from one another so as to provide for rotating a polarization of said electromagnetic wave at said second patch element relative to said polarization at said first conductive patch element.

12. A multi-beam antenna as recited in claim 2, wherein said at least one dielectric layer comprises at least first and second dielectric layers, said first surface of said at least one dielectric layer comprises a first surface of said first dielectric layer, said second surface of said at least one dielectric layer comprises a first surface of said second dielectric layer, further comprising a conductive layer interposed between a second surface of said first dielectric layer and a second surface of said second dielectric layer, wherein said at least one delay element is interconnected with an interconnection through said first and second dielectric layers and through said conductive layer, and said interconnection is insulated from said conductive layer.

13. A multi-beam antenna as recited in claim 2, wherein said at least one dielectric layer comprises at least first and second dielectric layers, said first surface of said at least one dielectric layer comprises a first surface of said first dielectric layer, said second surface of said at least one dielectric layer comprises a first surface of said second dielectric layer, said at least one delay element comprises at least one transmission line interposed between a second surface of said first dielectric layer and a second surface of said second dielectric layer, a first end of said at least one delay element is operatively coupled to said first conductive patch element with a first conductive interconnection through said first dielectric layer, and a second end of said at least one delay element is operatively coupled to said second conductive patch element with a second conductive interconnection through said second dielectric layer.

14. A multi-beam antenna as recited in claim 13, wherein said at least one delay element comprises a loop portion, and said loop portion is at least partially shadowed by said first and second conductive patch elements.

15. A multi-beam antenna as recited in claim 13, further comprising a conductive layer interposed between said second surface of said first dielectric layer and said second surface of said second dielectric layer, wherein said conductive layer is insulated from said at least one delay element.

16. A multi-beam antenna as recited in claim 2, wherein said at least one dielectric layer comprises at least first, second and third dielectric layers, said first surface of said at least one dielectric layer comprises a first surface of said first dielectric layer, said second surface of said at least one dielectric layer comprises a first surface of said second dielectric layer, said third dielectric layer is interposed between said first and second dielectric layers, further comprising a conductive layer interposed between said second and third dielectric layers, wherein said at least one delay element comprises at least one transmission line interposed between a second surface of said first dielectric layer and said third dielectric layer, a first end of said at least one delay element is operatively coupled to said first conductive patch element with a first conductive interconnection through said first dielectric layer, a second end of said at least one delay element is operatively coupled to said second conductive patch element with a second conductive interconnection through said second and third dielectric layers and through said conductive layer, and said second conductive interconnection is insulated from said conductive layer.

17. A multi-beam antenna as recited in claim 16, wherein said at least one delay element is at least partially shadowed by said first and second conductive patch elements.

18. A multi-beam antenna as recited in claim 2, wherein said at least one dielectric layer comprises at least first, second, third and fourth dielectric layers, said first surface of said at least one dielectric layer comprises a first surface of said first dielectric layer, said second surface of said at least one dielectric layer comprises a first surface of said second dielectric layer, said third dielectric layer is interposed between said first and second dielectric layers, said fourth dielectric layer is interposed between said third and second dielectric layers, further comprising a conductive layer interposed between said third and fourth dielectric layers, wherein said at least one delay element comprises first and second transmission lines, said first transmission line is interposed between said first and third dielectric layers, said second transmission line is interposed between said second and fourth dielectric layers, a first end of said first transmission line is operatively coupled to said first conductive patch element with a first conductive interconnection through said first dielectric layer, a first end of said second transmission line is operatively coupled to said second conductive patch element with a second conductive interconnection through said second dielectric layer, second ends of said first and second transmission lines are operatively coupled to one another with a third conductive interconnection through said third and fourth dielectric layers and through said conductive layer, and said third conductive interconnection is insulated from said conductive layer.

19. A multi-beam antenna as recited in claim 18, wherein said at least one delay element is at least partially shadowed by said first and second conductive patch elements.

20. A multi-beam antenna as recited in claim 2, wherein at least one of said first and second conductive patch elements comprises either a circular shape, a rectangular shape, a square shape, a triangular shape, a pentagonal shape, a hexagonal shape, or a polygonal shape.

21. A multi-beam antenna as recited in claim 2, wherein said delay period for each of said plurality of lens elements in said discrete lens array is adapted with respect to a corresponding plurality of locations of said plurality of lens elements in said discrete lens array so that said discrete lens array emulates a dielectric electromagnetic lens selected from an at least partially spherical dielectric electromagnetic lens, an at least partially cylindrical dielectric electromagnetic lens, an at least partially elliptical dielectric electromagnetic lens, and an at least partially rotational dielectric electromagnetic lens.

22. A multi-beam antenna as recited in claim 1, wherein said electromagnetic lens comprises a plurality of lens elements in a discrete lens array, wherein each said lens element comprises: a conductive surface; a conductive patch element; at least one dielectric layer interposed between said conductive patch element and said conductive surface, and at least one delay element operative between said patch element and said conductive surface.

23. A multi-beam antenna as recited in claim 22, wherein said at least one delay element comprises at least one transmission line that operates in cooperation with said at least one dielectric layer, a first end of said at least one transmission line is operatively coupled to said conductive patch element, a second end of said at least one transmission line is operatively coupled to said conductive surface, and said at least one transmission line comprises a conductive interconnection through said at least one dielectric layer.

24. A multi-beam antenna as recited in claim 22, wherein said delay period for each of said plurality of lens elements in said discrete lens array is adapted with respect to a corresponding plurality of locations of said plurality of lens elements in said discrete lens array so that said discrete lens array emulates a dielectric electromagnetic lens selected from an at least partially spherical dielectric electromagnetic lens, an at least partially cylindrical dielectric electromagnetic lens, an at least partially elliptical dielectric electromagnetic lens, and an at least partially rotational dielectric electromagnetic lens.

25. A multi-beam antenna, comprising:

a. an electromagnetic lens, wherein said electromagnetic lens comprises a discrete lens array;

b. a dielectric substrate in a cooperative relationship with said electromagnetic lens; and c. a plurality of antenna feed elements on said dielectric substrate at a corresponding plurality of locations and oriented in a corresponding plurality of directions, wherein at least two of said plurality of antenna elements are located at a corresponding at least two different locations, said at least two of said plurality of antenna elements are each adapted to act along a corresponding at least two different directions, and said at least two different directions and said at least two different locations are adapted in relation to a nominal focal surface of said electromagnetic lens so as to provide for at least one of transmitting and receiving a plurality of different electromagnetic beams in or from a plurality of different said directions in cooperation with said electromagnetic lens.

* * * * *